US010539914B2

(12) United States Patent
Awano et al.

(10) Patent No.: US 10,539,914 B2
(45) Date of Patent: Jan. 21, 2020

(54) BINDING PROCESSING DEVICE

(71) Applicant: FUJI XEROX CO., LTD., Tokyo (JP)

(72) Inventors: Hiroaki Awano, Yokohama (JP); Masashi Matsumoto, Yokohama (JP); Takuya Makita, Yokohama (JP); Katsumi Harada, Yokohama (JP); Kojiro Tsutsumi, Yokohama (JP); Toshiyasu Yukawa, Yokohama (JP); Takashi Ogino, Ebina (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/786,022

(22) Filed: Oct. 17, 2017

(65) Prior Publication Data

US 2018/0292779 A1 Oct. 11, 2018

(30) Foreign Application Priority Data

Apr. 7, 2017 (JP) ..... 2017-076995
Apr. 7, 2017 (JP) ..... 2017-076996
Apr. 7, 2017 (JP) ..... 2017-076997

(51) Int. Cl.

| | |
|---|---|
| ***B65H 37/04*** | (2006.01) |
| ***G03G 15/00*** | (2006.01) |
| ***B42B 4/00*** | (2006.01) |
| ***B42B 5/00*** | (2006.01) |

(52) U.S. Cl.

CPC ..... *G03G 15/6544* (2013.01); *B42B 4/00* (2013.01); *B42B 5/00* (2013.01); *B65H 37/04* (2013.01); *B65H 2301/51611* (2013.01); *B65H 2301/51616* (2013.01); *B65H 2408/1222* (2013.01); *B65H 2801/27* (2013.01)

(58) Field of Classification Search

CPC ..... B65H 37/04; B65H 2301/51611; B65H 2301/51616; B42B 4/00; B42B 5/00; G03G 15/6544

USPC ..... 270/58.08

See application file for complete search history.

(56) References Cited

U.S. PATENT DOCUMENTS 8,235,375 B2 * 8/2012 Shiraishi ..... B65H 31/02 270/58.08
8,246,033 B2 * 8/2012 Sato ..... B42C 1/12 270/58.07

(Continued)

FOREIGN PATENT DOCUMENTS

CN 1704207 A 12/2005
CN 1911680 A 2/2007

(Continued)

OTHER PUBLICATIONS

May 29, 2019 Office Action issued in Chinese Patent Application No. 201711306784.0.

*Primary Examiner* — Leslie A Nicholson, III
(74) *Attorney, Agent, or Firm* — Oliff PLC

(57) ABSTRACT

A binding processing device includes: a needle binding unit that forms a needle binding portion that binds a paper bundle using a needle; a needleless binding unit that forms a needleless binding portion that binds the paper bundle without using a needle; and a plurality of exit rolls that exit the bound paper bundle. A distance between the needleless binding portion and a center of the plurality of exit rolls is equal to or longer than a distance between the needle binding portion and the center.

17 Claims, 16 Drawing Sheets

(56) References Cited

U.S. PATENT DOCUMENTS

| | | | | |
|---|---|---|---|---|
| 8,297,610 | B2 * | 10/2012 | Shiraishi | B65H 37/04 270/58.08 |
| 9,409,740 | B2 * | 8/2016 | Kubo | G03G 15/6541 |
| 9,651,911 | B2 * | 5/2017 | Kanamoto | G03G 15/6544 |
| 9,944,488 | B2 * | 4/2018 | Kunieda | B65H 37/04 |
| 10,029,880 | B2 * | 7/2018 | Ishihara | B31F 5/001 |
| 10,046,940 | B2 * | 8/2018 | Obuchi | B65H 31/36 |
| 10,097,711 | B2 * | 10/2018 | Suzuki | B65H 33/00 |
| 10,131,107 | B2 * | 11/2018 | Shimizu | B31F 5/02 |
| 2007/0036637 | A1 | 2/2007 | Hata et al. | |
| 2012/0018944 | A1 | 1/2012 | Shiraishi | |
| 2013/0214470 | A1 | 8/2013 | Yokomizo | |
| 2015/0014384 | A1 | 1/2015 | Obuchi et al. | |
| 2015/0014913 | A1 * | 1/2015 | Obuchi | B65H 31/36 270/58.12 |
| 2016/0187832 | A1 * | 6/2016 | Kanamoto | G03G 15/6544 399/408 |
| 2016/0340145 | A1 * | 11/2016 | Kunieda | B65H 37/04 |
| 2016/0360053 | A1 * | 12/2016 | Suzuki | B65H 33/00 |
| 2017/0008723 | A1 * | 1/2017 | Shimizu | B31F 5/02 |
| 2017/0101285 | A1 * | 4/2017 | Ishihara | B31F 5/001 |
| 2017/0160691 | A1 | 6/2017 | Obuchi et al. | |
| 2017/0253456 | A1 | 9/2017 | Yokomizo | |
| 2018/0321626 | A1 | 11/2018 | Obuchi et al. | |

FOREIGN PATENT DOCUMENTS

| | | | |
|---|---|---|---|
| CN | 103287912 | A | 9/2013 |
| CN | 104276438 | A | 1/2015 |
| JP | 2011-201698 | A | 10/2011 |
| JP | 2012-025499 | A | 2/2012 |

* cited by examiner

BINDING PROCESSING DEVICE

CROSS-REFERENCE TO RELATED APPLICATIONS

This application is based on and claims priorities under 35 USC 119 from Japanese Patent Application No. 2017-076995 filed on Apr. 7, 2017, Japanese Patent Application No. 2017-076996 filed on Apr. 7, 2017, and Japanese Patent Application No. 2017-076997 filed on Apr. 7, 2017.

BACKGROUND

Technical Field

The present invention relates to a binding processing device.

Related Art

In the related art, a binding processing device which binds a paper bundle without using a staple needle is proposed.

SUMMARY

According to an exemplary embodiment of the invention, there is provided a binding processing device including: a needle binding unit that forms a needle binding portion that binds a paper bundle using a needle; a needleless binding unit that forms a needleless binding portion that binds the paper bundle without using a needle; and a plurality of exit rolls that exit the bound paper bundle. A distance between the needleless binding portion and a center of the plurality of exit rolls is equal to or longer than a distance between the needle binding portion and the center.

BRIEF DESCRIPTION OF THE DRAWINGS

Exemplary embodiment(s) of the present invention will be described in detail based on the following figures, wherein.

DETAILED DESCRIPTION

Hereinafter, exemplary embodiments will be described in detail with reference to attached drawings.

Figure 1:
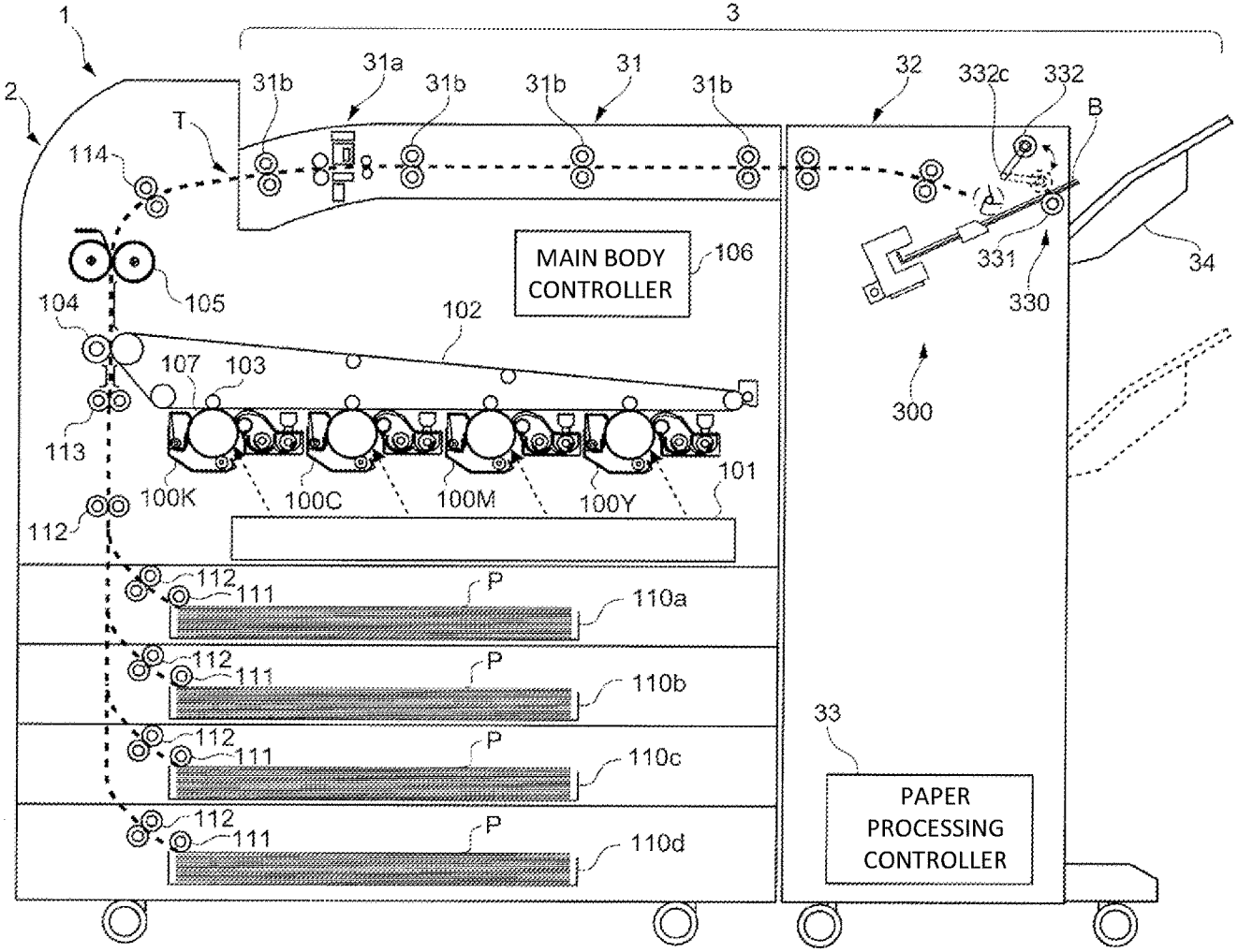
FIG. 1 is a view illustrating a schematic configuration of a paper processing system to which a binding processing device according to a first exemplary embodiment is applied.

FIG. 1 is a view illustrating a schematic configuration of a paper processing system 1 to which a binding processing device 300 according to a first exemplary embodiment is applied.

The paper processing system 1 is provided with an image forming apparatus 2 which forms an image on paper P by an electrophotographic process or the like, and a post-processing device 3 which performs a post-process such as binding on plural sheets of the paper P with the image formed by the image forming apparatus 2.

(Image Forming Apparatus)

The image forming apparatus 2 is configured as a so-called tandem system, and is provided with four image forming units 100Y, 100M, 100C, and 100K (also referred to as "image forming unit 100") which perform an image forming process based on data relating to each color image. Each image forming unit 100 includes a photoconductor drum 100*a*.

The image forming apparatus 2 is provided with a laser exposure device 101 which exposes the photoconductor drum 100*a* placed in each image forming unit 100, and forms an electrostatic latent image on a surface of the photoconductor drum 100*a*.

The image forming apparatus 2 is provided with an intermediate transfer belt 102 where a toner image of each color, which is formed by each image forming unit 100, is multiply transferred, and a primary transfer roll 103 which sequentially transfers (primary transfers) the toner image of each color formed by each image forming unit 100 to the intermediate transfer belt 102. In addition, the image forming apparatus 2 is provided with a secondary transfer roll 104 which collectively transfers (secondary transfers) the toner image of each color transferred to the intermediate transfer belt 102 to the paper P.

The image forming apparatus 2 is provided with a fixing device 105 which fixes the secondary transferred toner image of each color onto the paper P, and a main body controller 106 which controls operations of the image forming apparatus 2.

The image forming apparatus 2 is provided with plural paper collecting portions 110*a* to 110*d* which collect the paper P of different sizes or different types, pickup rolls 111 which retrieve the paper P from the paper collecting portions 110*a* to 110*d*, transporting rollers 112 which transport the retrieved paper P, and registration rolls 113 disposed between the transporting rollers 112 and the secondary transfer rolls 104.

In the image forming apparatus 2 configured as described above, in accordance with a timing, when the toner image of each color on the intermediate transfer belt 102 is transported to a facing portion (secondary transfer portion) that the secondary transfer roll 104 and the intermediate transfer belt 102 face, the paper P is transported from the registration roll 113 to the secondary transfer portion.

Also, due to action of a transfer electric field generated by the secondary transfer roll 104, the toner image of each color on the intermediate transfer belt 102 is collectively and electrostatically transferred (secondary transferred) onto the paper P.

After that, the paper P, to which the toner image of each color is transferred, is transported to the fixing device 105 by being peeled from the intermediate transfer belt 102. The toner image of each color is fixed onto the paper P by a fixing process with heat and pressure using the fixing device 105, and thus an image is formed on the paper P.

The paper P, on which the image is formed, is exited from the paper exit portion T of the image forming apparatus 2 by the transporting roller 114, and is supplied to the post-processing device 3 connected to the image forming apparatus 2.

(Post-Processing Device)

The post-processing device 3 is provided with a transport unit 31 which is connected to the paper exit portion T of the image forming apparatus 2, and a finisher unit 32 which performs a process set in advance on the paper P which is transported by the transport unit 31.

The transport unit 31 is provided with a punching function portion 31*a* performing boring (punching) of two holes, four holes, or the like, and plural transporting rollers 31*b* which transport the paper P, on which an image is formed by the image forming apparatus 2, toward the finisher unit 32.

The finisher unit 32 is provided with the binding processing device 300 which performs a binding process on a paper bundle B configured with plural sheets of the paper P. The binding processing device 300 will be described later in detail.

The post-processing device 3 is provided with a paper processing controller 33 which controls each of mechanism portions of the post-processing device 3. The paper processing controller 33 includes an arithmetic logic circuit configured with a CPU, a ROM, a RAM, a back-up RAM, and the like, and for example, controls the binding processing device 300 so that sizes or positions of a needle binding portion 410 and a needleless binding portion 550 to be described later becomes that of an aspect to be described later. The paper processing controller 33 is connected to the main body controller 106 through a signal line which is not illustrated, and these sections mutually transmit and receive a control signal or the like. Also, in FIG. 1, an example of which the paper processing controller 33 is placed inside a case of the finisher unit 32 is illustrated, but the paper processing controller 33 may be placed inside of the image forming apparatus 2. In addition, the main body controller 106 of the image forming apparatus 2 may include a control function of the paper processing controller 33.

The post-processing device 3 is provided with a stacking portion 34 where the paper bundle B processed by the post-processing device 3 are stacked.

{Binding Processing Device}

Figure 2:
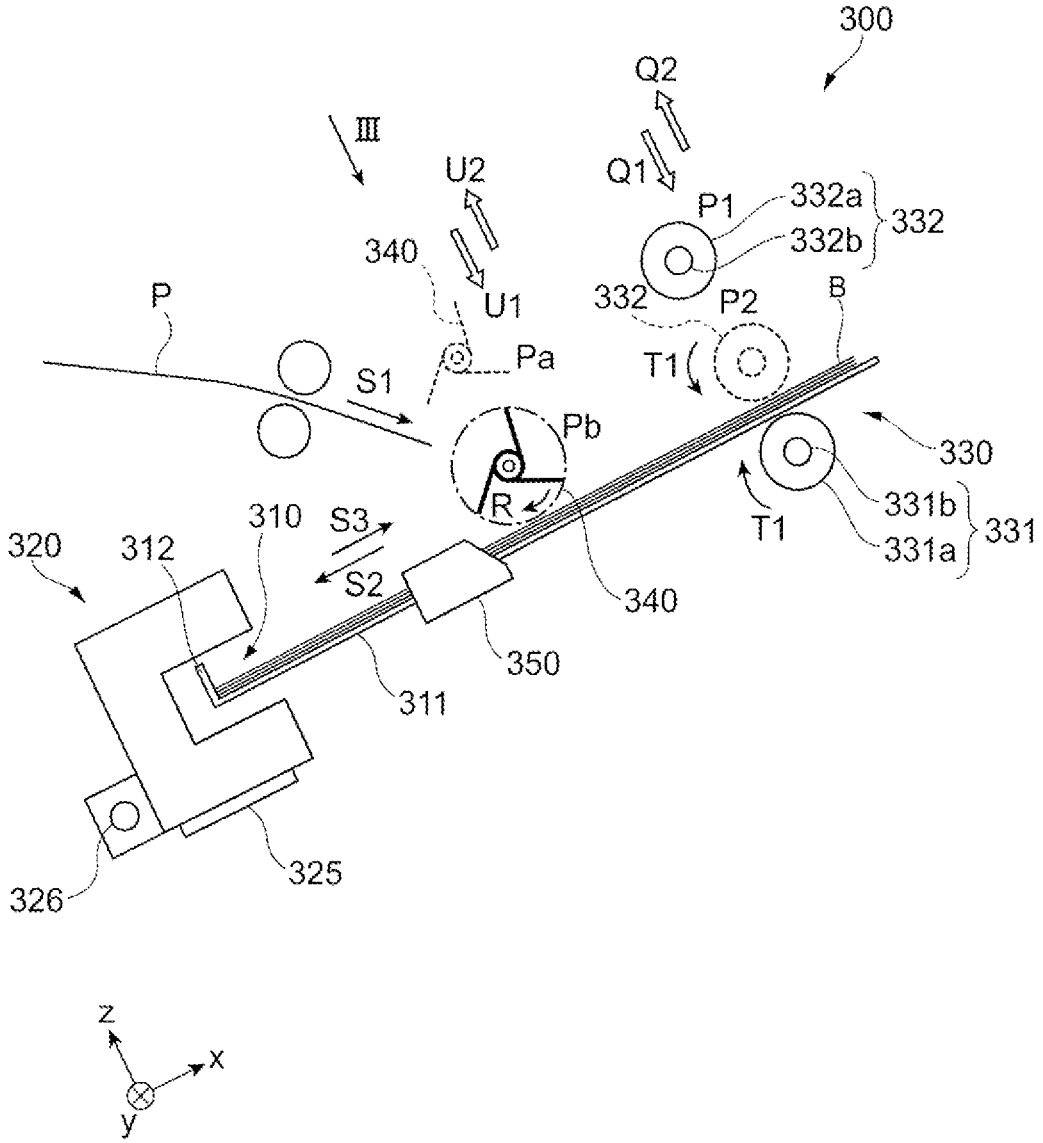
FIG. 2 is a view illustrating a schematic configuration of the binding processing device.

FIG. 2 is a view illustrating a schematic configuration of the binding processing device 300.

Figure 3:
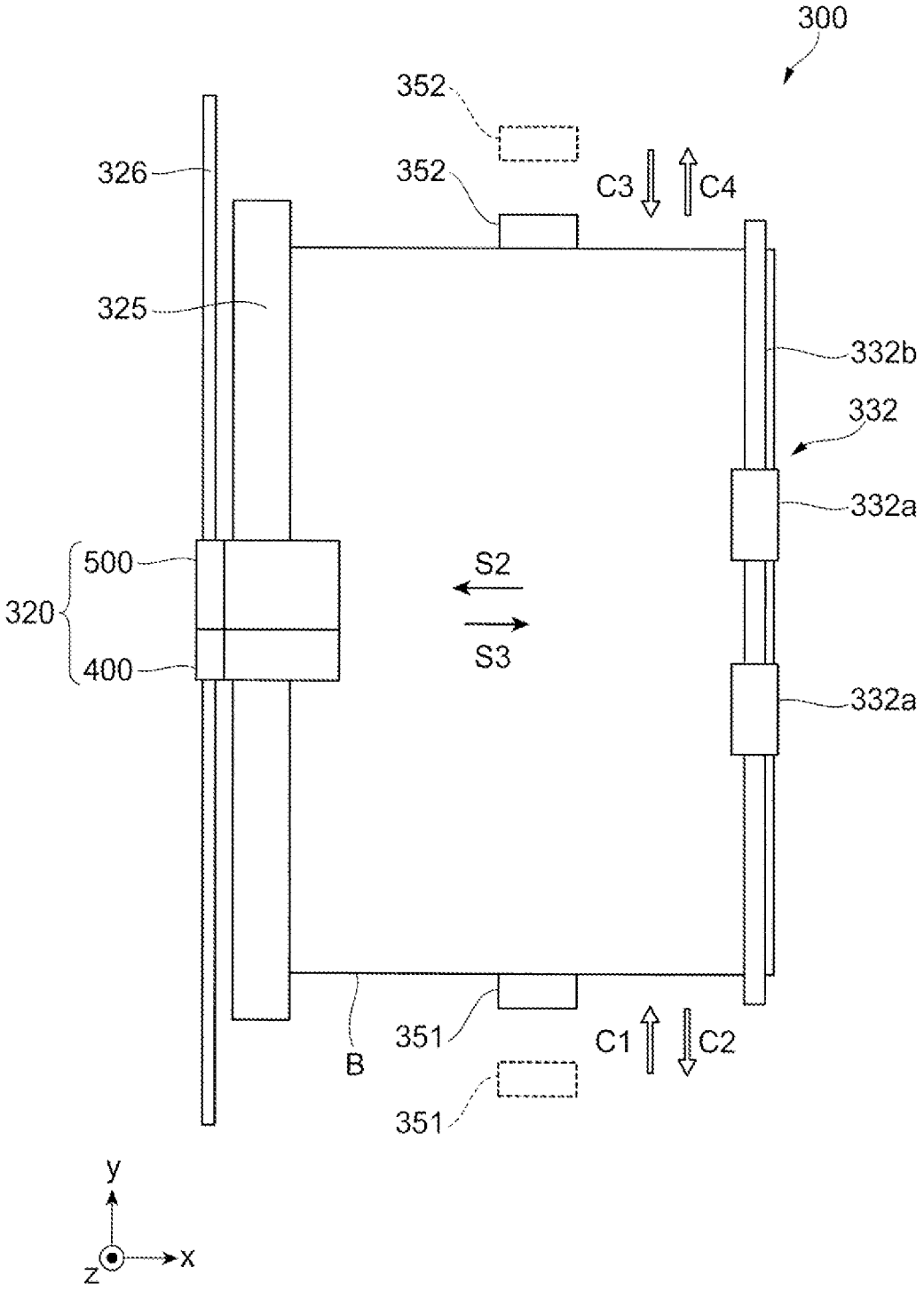
FIG. 3 is a view of the binding processing device seen in III direction of FIG. 2.

FIG. 3 is a view of the binding processing device seen in III direction of FIG. 2. The binding processing device 300 is provided with a paper accumulating portion 310 which generates the paper bundle B by supporting the paper P from the bottom and accumulating the paper P as necessary number of sheets, a binding unit 320 which performs the binding process on the paper bundle B, and a rail 325 and a supporting shaft 326 which movably support the binding unit 320.

In addition, the binding processing device 300 is provided with an exit portion 330 which rotates in a clockwise direction in FIG. 2 and exits the paper bundle B on the paper accumulating portion 310 to the stacking portion 34.

The binding processing device 300 is provided with a paddle 340 which moves the paper P toward a paper regulating portion 312 to be described later, which is placed in an end portion of the paper accumulating portion 310, and a tamper 350 which aligns end portions in a proceeding direction of the paper P.

The paper accumulating portion 310 is provided with a bottom portion 311, which includes an upper surface where the paper P is mounted and is disposed to be inclined in a vertical direction, and a paper regulating portion 312 which is placed on a lower end surface in the bottom portion 311 and regulates downward movement of the paper P.

The binding unit 320 will be described later in detail.

The exit portion 330 is provided with a fixing side exit member 331 which is rotatably placed with respect to a case of an apparatus. In addition, the exit portion 330 is provided with a moving side exit member 332. The moving side exit member 332 is placed so as to swing around a rotating shaft 332*c* (refer to FIG. 1). The moving side exit member 332 presses the paper bundle B on the paper accumulating portion 310 when the generated paper bundle B is transported to the stacking portion 34, and retracts from a transporting path of the paper P when the paper P is accumulated in the paper accumulating portion 310.

The fixing side exit member 331 includes two fixing side exit rolls 331*a* which are members pressing against the paper bundle B, and a fixing side roll supporting member 331*b* which supports the two fixing side exit rolls 331*a*.

The moving side exit member 332 includes two moving side exit rolls 332*a* which are members pressing against the paper bundle B, and a moving side roll supporting member 332*b* which supports the two moving side exit rolls 332*a*.

The fixing side exit member 331 and the moving side exit member 332 are disposed to face an upper side and a lower side of the bottom portion 311 with the bottom portion 311 of the paper accumulating portion 310 therebetween. The paper bundle B is exited to the stacking portion 34 by being pressed using the fixing side exit roll 331*a* and the moving side exit roll 332*a* facing each other. It is possible to exemplify that the fixing side exit roll 331*a* and the moving side exit roll 332*a* are the same members and lengths in a with direction of the paper bundle B are the same as each other. Hereinafter, a pair of rolls configured with the fixing side exit roll 331*a* and the moving side exit roll 332*a* facing each other is referred to as an "exit roll 333".

The moving side exit member 332 is placed on an upper surface side, where the paper P is stacked, in the bottom portion 311 of the paper accumulating portion 310. Further, the moving side exit member 332 is provided to be able to advance and retract with respect to the fixing side exit member 331 when a motor or the like, which is not illustrated, is driven. That is, a distance between the moving side exit member 332 and the paper P stacked on the bottom portion 311 of the paper accumulating portion 310 is changed. Meanwhile, the fixing side exit member 331 is positioned on a back side of an upper surface where the paper P is stacked in the bottom portion 311 of the paper accumulating portion 310, and a position thereof is fixed and is provided to perform only rotational movement.

More specifically, the moving side exit member 332 moves in an arrow Q1 direction, and the moving side exit member 332 approaches the bottom portion 311 of the paper accumulating portion 310 (position P2 drawn by broken line). Meanwhile, the moving side exit member 332 moves in an arrow Q2 direction, and the moving side exit member 332 is separated from the bottom portion 311 of the paper accumulating portion 310 (position P1 drawn by solid line).

Also, in a state in which the moving side exit member 332 is in contact with the paper P when a motor or the like, which is not illustrated, and is driven, the moving side exit member 332 exits the paper bundle B by being rotated in a T1 direction (in counterclockwise rotation direction of FIG. 2) and rising the paper bundle B (moving paper bundle in third proceeding direction S3).

Also, the positions P1 and P2 of the moving side exit member 332 may be changed depending on a number of sheets or a thickness of the paper P being supplied to the paper accumulating portion 310.

The paddle 340 is provided in an upper side of the paper accumulating portion 310, and is placed on an upstream side of an exit direction of the paper bundle B with respect to the exit portion 330. In addition, the paddle 340 is provided, such that a distance between the paddle and the bottom portion 311 of the paper accumulating portion 310 when a motor or the like, which is not illustrated, is driven is changed. Specifically, the paddle 340 is provided to be movable in arrow directions U1 and U2 of FIG. 2, approaches the bottom portion 311 of the paper accumulating portion 310 by moving in the arrow U1 direction, and is separated from the bottom portion 311 of the paper accumulating portion 310 by moving in the arrow U2 direction. Also, the paddle 340 causes the paper P, which is transported along a first proceeding direction S1 of FIG. 2, to be moved toward the paper regulating portion 312 (in second proceeding direction S2) by rotating in an arrow R direction (clockwise rotation direction of FIG. 2) of FIG. 2.

The tamper 350 includes a first tamper 351 and a second tamper 352 which face each other with the paper accumulating portion 310 therebetween. Specifically, the first tamper 351 and the second tamper 352 are disposed so as to face each other in a direction intersecting a second proceeding direction S2 (vertical direction in FIG. 3). Also, the first tamper 351 and the second tamper 352 are configured in order to change a distance between the first tamper 351 and the second tamper 352 when a motor or the like, which is not illustrated, is driven.

Here, the tamper 350 is configured to include an end portion in a proceeding direction of the paper P which falls down along the bottom portion 311 of the paper accumulating portion 310. Specifically, the first tamper 351 is disposed to move (arrows C1 and C2) between a position approaching the paper accumulating portion 310 (position drawn by solid line) and a position separated from the paper accumulating portion 310 (position drawn by broken line). Meanwhile, the second tamper 352 is configured to move (arrows C3 and C4) between the position approaching the paper accumulating portion 310 (position drawn by solid line) and the position separated from the paper accumulating portion 310 (position drawn by broken line).

Each position of the first tamper 351 and the second tamper 352 in the exemplary embodiment is changed depending on a paper size or a direction of the paper P being supplied to the paper accumulating portion 310.

Also, in FIG. 2, a direction where the paper bundle B is exited from the paper accumulating portion 310 to the stacking portion 34 by the exit portion 330 is set to an x direction, a direction (width direction of paper bundle B) orthogonal to an exit direction of the paper bundle B inside a collecting surface of the paper accumulating portion 310 is set to as a y direction, and a direction orthogonal to the collecting surface of the paper accumulating portion 310 is set to a z direction. The directions are also the same as those of drawings to be described later.

In addition, a lower side in FIG. 3 shows a user side of the paper processing system 1, and shows a front side of a paper surface in FIGS. 1 and 2.

[Binding Unit]

The binding unit 320 is provided with a stapler 400 as an example of a needle binding unit which binds the paper bundle B using a staple needle, and a needleless binding device 500 as an example of a needleless binding unit binding the paper bundle B without using a needle.

The stapler 400 and the needleless binding device 500 are connected to each other, and placed to continue in a direction orthogonal to an exit direction of the paper bundle B (width direction (y direction)). The stapler 400 is disposed on a user side of the paper processing system 1 closer than the needleless binding device 500 (lower side in FIG. 3). The stapler 400 is disposed on the user side (lower side in FIG. 3), and thereby making it possible to easily perform a maintenance work, such as filling up of staple needles, with respect to the stapler 400.

The binding unit 320 is disposed on a rail 325 placed in a case of an apparatus, and is configured to be movable in the width direction (y direction) of the paper bundle B by a motor which is not illustrated. When the binding unit 320 is movable in the width direction (y direction) of the paper bundle B, the stapler 400 and the needleless binding device 500 are capable of performing a binding process at any position in the width direction (y direction) of the paper bundle B.

Also, the stapler 400 and the needleless binding device 500 may not be connected to each other.

<<Stapler>>

The stapler 400 is configured to bind end portions of the paper bundle B, which is generated in the paper accumulating portion 310, by pushing a staple needle into the paper P. That is, a stapler motor which is not illustrated is driven, and the stapler 400 pushes one staple needle into the paper bundle B. The staple needle is pushed into the paper bundle B and end portions of the staple needle are bent on an opposite side of the paper bundle B, and thus the paper bundle B is bound. Accordingly, the paper bundle B bound by the staple needle is generated.

<<Needleless Binding Device>>

Figure 4A:
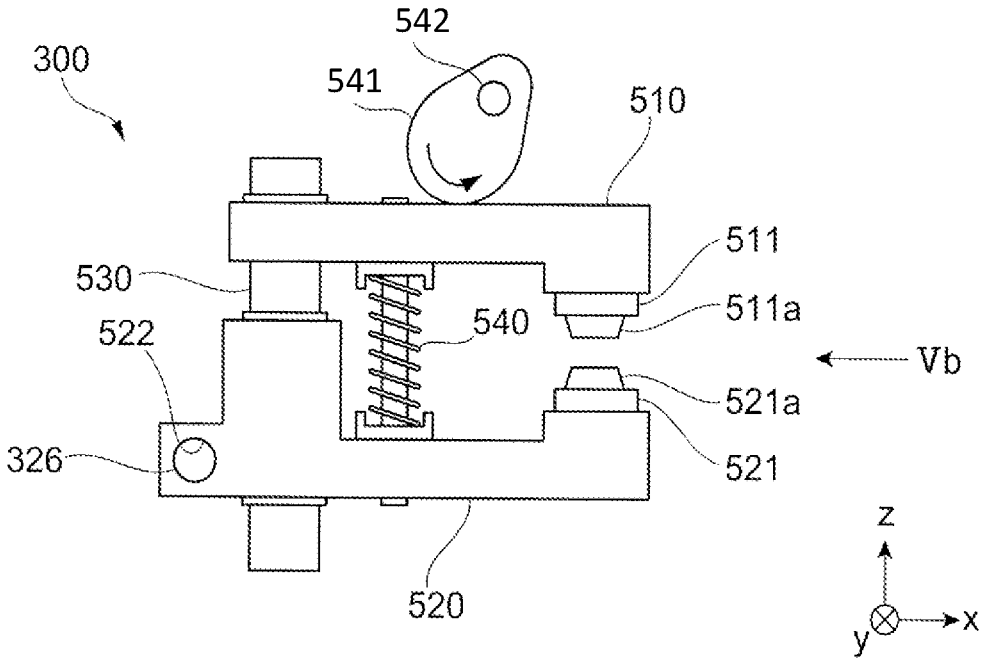
FIG. 4A is a view illustrating a schematic configuration of a needleless binding device in a state before binding a paper bundle.
Figure 4B:
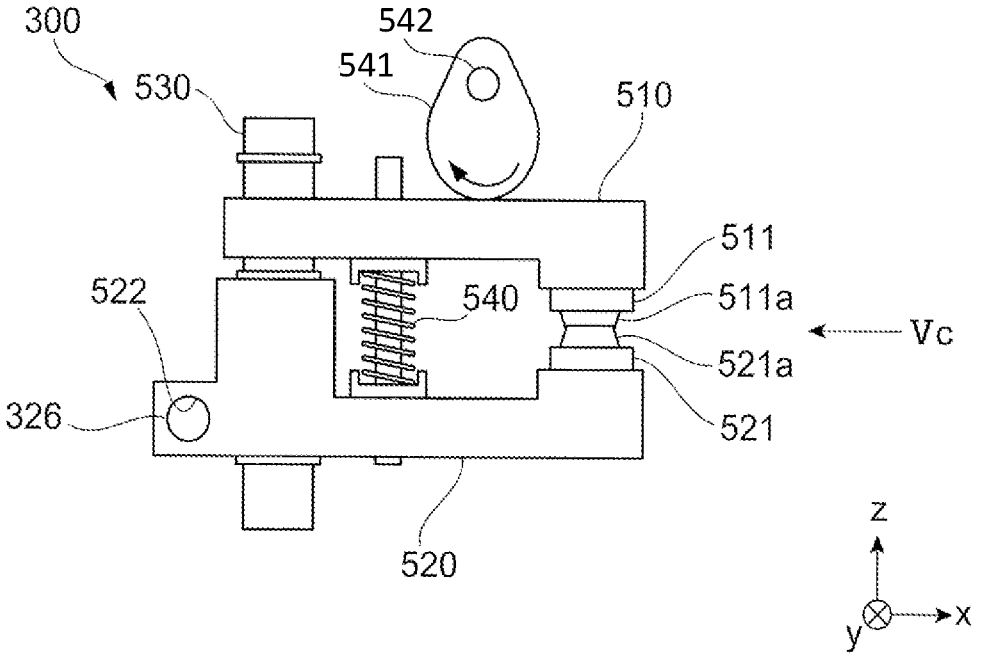
FIG. 4B is a view illustrating a schematic configuration of a needleless binding device in a state at the time of binding the paper bundle.

FIGS. 4A and 4B are views illustrating a schematic configuration of the needleless binding device 500. FIG. 4A illustrates a state before the paper bundle B is bound, and FIG. 4B illustrates a state at the time of binding the paper bundle B.

Figure 5A:
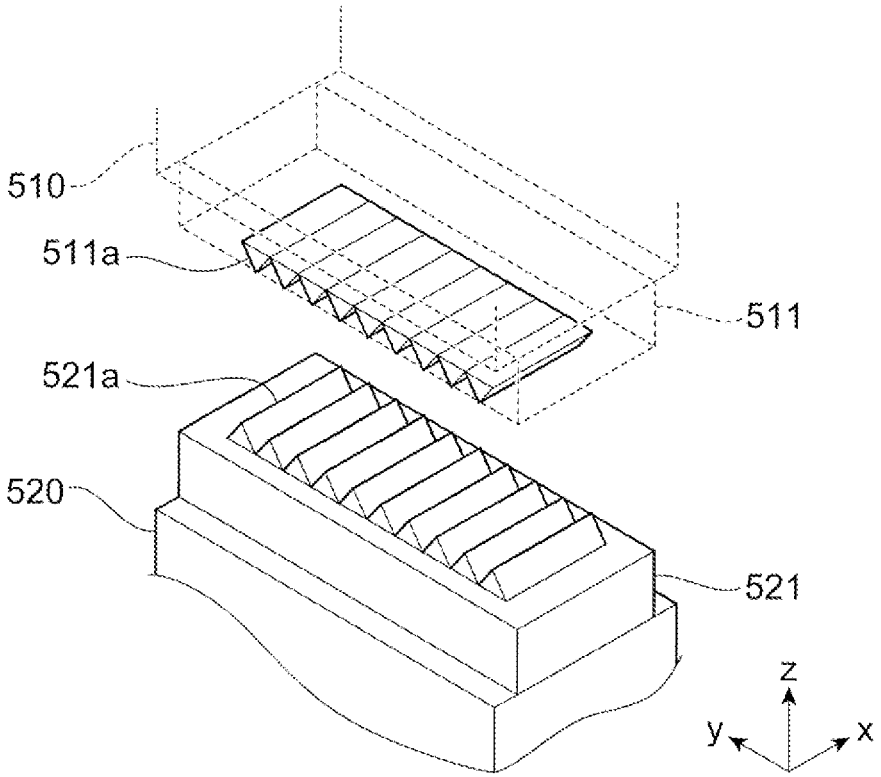
FIG. 5A is a perspective view of a first press-bonding member and a second press-bonding member of the needleless binding device.
Figure 5B:
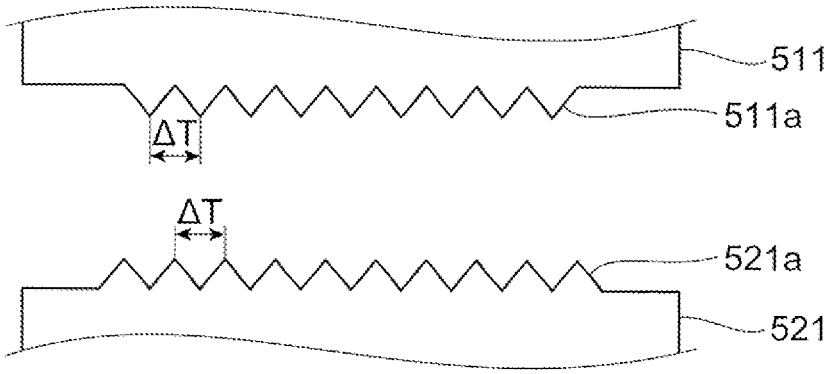
FIG. 5B is a view seen in Vb direction of FIG. 5A.
Figure 5C:
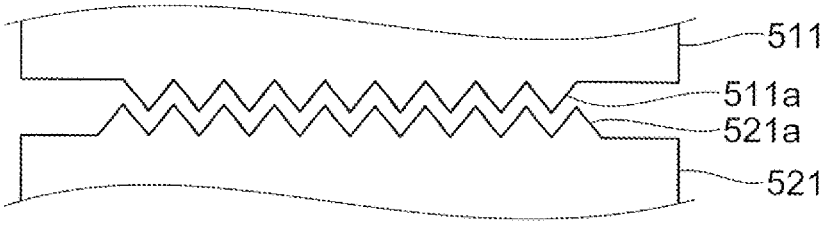
FIG. 5C is a view seen in Vc direction of FIG. 5B.

FIGS. 5A to 5C are views illustrating a first press-bonding member 511 and a second press-bonding member 521 to be described later of the needleless binding device 500. FIG. 5A is a perspective view of the first press-bonding member 511 and the second press-bonding member 521. FIG. 5B is a view when seen in Vb direction of FIG. 4A, and FIG. 5C is a view when seen in Vc direction of FIG. 4B.

The needleless binding device 500 is provided with a first driving portion 510 and a second driving portion 520 which are a pair of driving portions extending in a horizontal direction in FIG. 4, and a supporting shaft 530 supporting the first driving portion 510 and the second driving portion 520. In addition, the needleless binding device 500 is provided with a spring member 540 which exerts a pressing force causing the first driving portion 510 and the second driving portion 520 to be separated from each other, and a cam 541 which presses down the first driving portion 510 against the pressing force of the spring member 540.

The first driving portion 510 includes the first press-bonding member 511 placed in one end portion which is an end portion of the paper accumulating portion 310 side, and protrudes toward the second driving portion 520 side. In the first driving portion 510, a through hole penetrating the supporting shaft 530 (not illustrated) is formed in the other end portion.

The second driving portion 520 includes the second press-bonding member 521 placed on one end portion which is an end portion of the paper accumulating portion 310 side, and protrudes toward the first driving portion 510 side. The second driving portion 520 is provided with a through hole (not illustrated) to which the supporting shaft 530 is fitted and fixed, and a through hole 522 where the supporting shaft 326 fixed to the case of the apparatus penetrates on the other end portion.

The supporting shaft 530 is a columnar member, one end portion is fixed to the second driving portion 520, and the other end portion is loosely fitted into the through hole formed in the first driving portion 510. Also, the supporting shaft 530 supports the first driving portion 510 to be movable in a vertical direction.

The spring member 540 is a coil spring, and one end portion is supported by the first driving portion 510, and the other end portion is supported by the second driving portion 520.

The cam 541 is rotated around the rotating shaft 542 by receiving a rotation driving force generated by a motor which is not illustrated.

In the needleless binding device 500, as illustrated in FIG. 4B, when the cam 541 is rotated in a counterclockwise rotation direction (refer to FIG. 4A) at only a preset angle due to a driving force of a driving motor (not illustrated) connected to the rotating shaft 542, the first driving portion 510 is pressed down against the pressing force from the spring member 540. Therefore, the first press-bonding member 511 of the first driving portion 510 and the second press-bonding member 521 of the second driving portion 520 are press-bonded.

Meanwhile, when the cam 541 is rotated in a clockwise direction (refer to FIG. 4B) in a state in which the first driving portion 510 is pressed down, the first driving portion 510 returns to a position where the first press-bonding member 511 and the second press-bonding member 521 are separated from each other (state illustrated in FIG. 4A) by the pressing force from the spring member 540.

The first press-bonding member 511 and the second press-bonding member 521 are configured with plural triangular projections (teeth) which are regularly arranged in, for example, a barcode shape, as illustrated in FIG. 5A, and a projection 511*a* of the first press-bonding member 511 and a projection 521*a* of the second press-bonding member 521 are set to be engaged with each other. That is, at the time of press-bonding the first press-bonding member 511 and the second press-bonding member 521, the projection 511*a* of the first press-bonding member 511 are respectively arranged so as to be positioned between the projections 521*a* of the second press-bonding member 521 (refer to FIG. 5C). Therefore, the paper P is sandwiched between the projection 511*a* of the first press-bonding member 511 and the projection 521*a* of the second press-bonding member 521, and is locally deformed, and thus, the paper bundle B is bound by engaging the paper P with each other (fibers constituting paper P are entangled with each other) in the deformed part (press-bonding binding portion).

Also, a shape of projections (teeth) of the first press-bonding member 511 and the second press-bonding member 521 may be any shape as long as the paper P is able to be locally deformed by engaging the first press-bonding member 511 and the second press-bonding member 521 with each other.

(Comparison of Binding Portion)

Figure 6A:
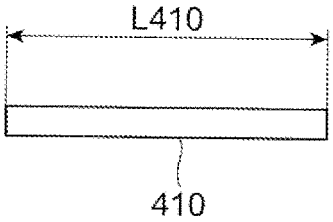
FIG. 6A is a view of a needle binding portion seen in a direction orthogonal to a paper surface.
Figure 6B:
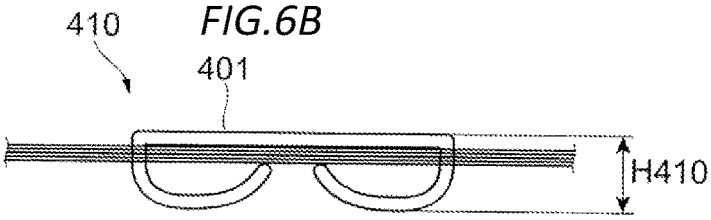
FIG. 6B is a view of the needle binding portion seen in an exit direction (x direction) of the paper bundle.
Figure 6C:
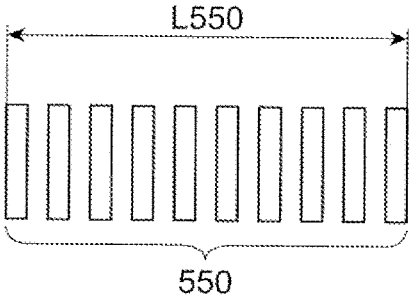
FIG. 6C is a view of a needleless binding portion seen in a direction orthogonal to a paper surface.
Figure 6D:
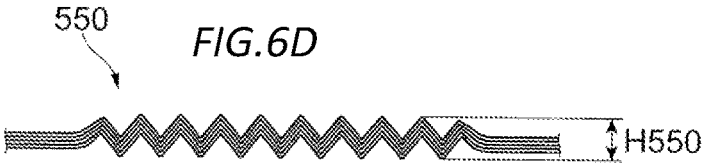
FIG. 6D is a view of the needleless binding portion seen in the exit direction (x direction) of the paper bundle.
Figure 6E:
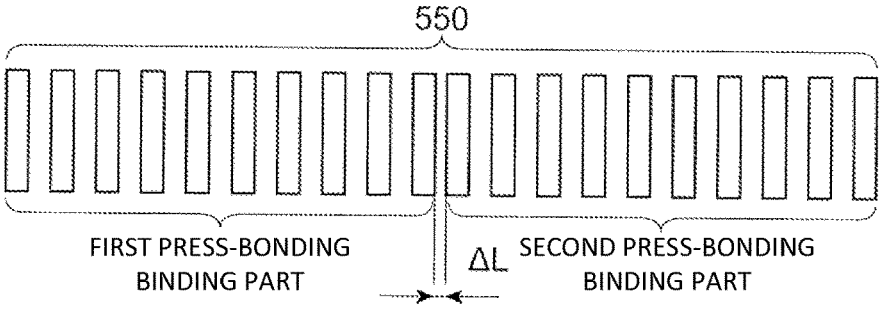
FIG. 6E is a view illustrating a range of the needleless binding portion.

FIGS. 6A to 6E are views comparing the needle binding portion 410 and the needleless binding portion 550. FIG. 6A is a view of the needle binding portion 410 seen in a direction orthogonal to a paper surface of the paper P. FIG. 6B is a view of the needle binding portion 410 seen in the exit direction (x direction) of the paper bundle. FIG. 6C is a view of the needleless binding portion 550 seen in a direction orthogonal to a paper surface of the paper P. FIG. 6D is a view of the needleless binding portion 550 seen in the exit direction (x direction) of the paper bundle. FIG. 6E is a view illustrating a range of the needleless binding portion 550.

The binding unit 320 moves in a width direction (y direction) along the supporting shaft 326 fixed to the case of the apparatus, and one or the plural binding portions which are set in advance may be formed in the paper bundle B. For example, in a case in which a user selects needle binding through a user interface, the paper processing controller 33 performs a needle binding process using the stapler 400. Meanwhile, for example, in a case in which the user selects needleless binding through the user interface, the paper processing controller 33 performs a needleless binding process using the needleless binding device 500. Hereinafter, a part bound by the stapler 400 is referred to as the "needle binding portion 410", and a part bound by the needleless binding device 500 is referred to as the "needleless binding portion 550".

As illustrated in FIG. 6A, a length L550 of the needleless binding portion 550 is longer than a length L410 of the needle binding portion 410. That is, a length of the width direction (y direction) of a part, which is sandwiched between the projection 511*a* of the first press-bonding member 511 of the first driving portion 510 and the projection 521*a* of the second press-bonding member 521 of the second driving portion 520 by one time binding process (press-bonding) of the needleless binding device 500, is longer than a length of the width direction (y direction) of a staple needle of the stapler 400. This is because that a binding force due to engaging the paper P each other (fibers constituting paper P are entangled with each other) is weaker than a binding force due to a staple needle 401 in a case in which both the lengths are the same as each other, and for example, the binding is easily deviated from the paper in a case in which the paper P of a part constituting the paper bundle B is turned over (the turned paper P is easily peeled off from the paper bundle B). Therefore, in the binding unit 320 according to the exemplary embodiment, the length of the width direction (y direction) of the needleless binding portion 550 is made to be longer than the length of the width direction (y direction) of the needle binding portion 410 so that the binding is not easily deviated from the paper.

Also, when the first press-bonding member 511 of the first driving portion 510 and the second press-bonding member 521 of the second driving portion 520 of the needleless binding device 500 are press-bonded at multiple times at positions close to each other, and plural press-bonded binding portions are formed at positions close to each other, one needleless binding portion 550 may be formed. For example, in a case in which a distance ΔL between the press-bonded binding portions illustrated in FIG. 6E is shorter than a distance ΔT (refer to FIG. 5B) between peaks of the projections (teeth) of the first press-bonding member 511 and the second press-bonding member 521, the plural press-bonded binding portions are formed at positions close to each other, and thus the plural press-bonded binding portions may constitute one needleless binding portion 550. Therefore, in order to make the length of the width direction (y direction) of the needleless binding portion 550 be longer than the length of the needle binding portion 410, the lengths of the width directions (y direction) of the first press-bonding member 511 and the second press-bonding member 521 may not necessarily be longer than the length of the staple needle 401.

(Position of Binding Portion)

Figure 7A:
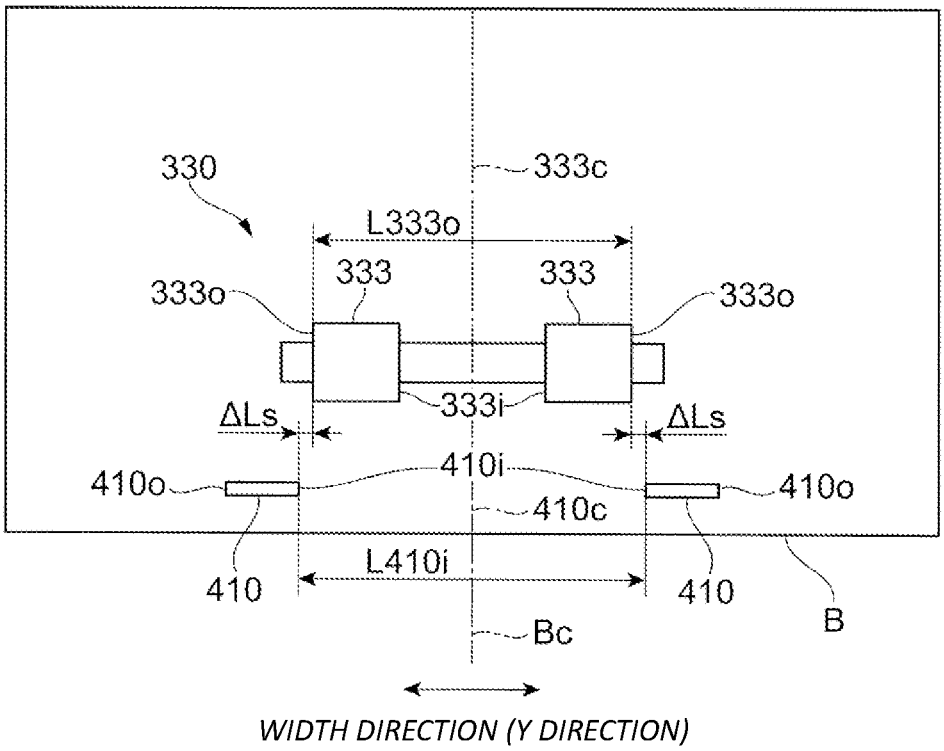
FIG. 7A is a view illustrating a position of the needle binding portion.
Figure 7B:
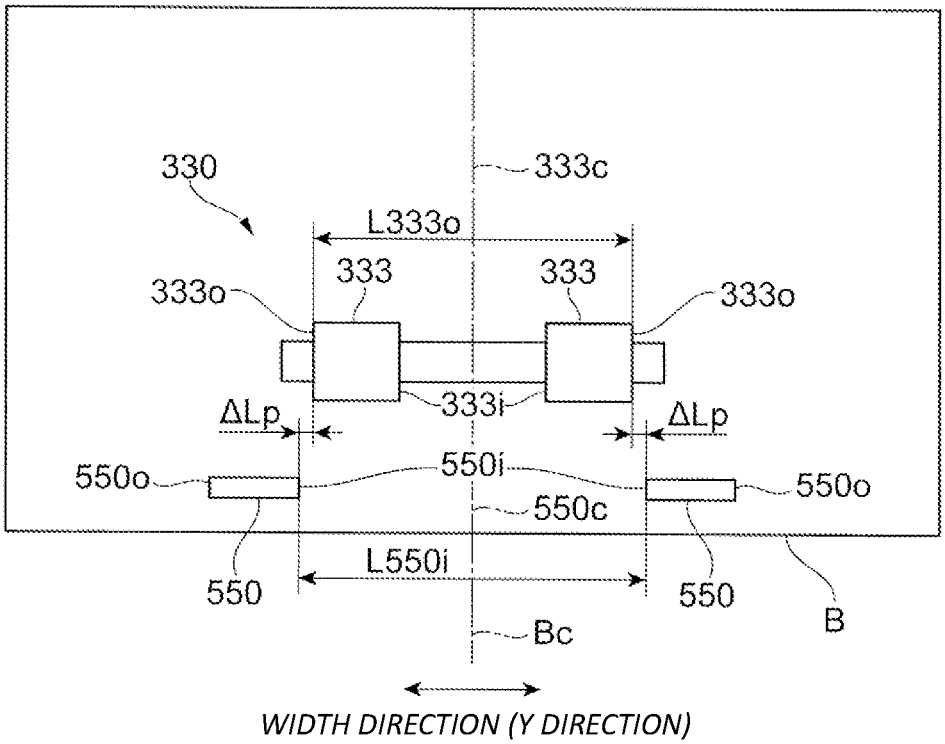
FIG. 7B is a view illustrating a position of the needleless binding portion.

FIG. 7A is a view illustrating a position of the needle binding portion 410, and FIG. 7B is a view illustrating a position of the needleless binding portion 550.

As illustrated in FIGS. 1 to 3, the exit roll 333 is disposed on a downstream side of the exit direction of the paper bundle (x direction) of the binding unit 320. When the binding unit 320 finishes generating of the paper bundle B, the exit roll 333 exits the paper bundle B to the stacking portion 34. Therefore, the paper bundle B on which the binding process is performed is pressed by the exit roll 333. Two exit rolls 333 (a pair of the fixing side exit roll 331*a* and the moving side exit roll 332*a*) are placed in the width direction (y direction) of the paper bundle B.

Since the needleless binding portion 550 bound by the needleless binding device 500 suppresses generation of looseness or peeling due to a pressing force received from the exit roll 333, in the binding unit 320 according to the exemplary embodiment, the needleless binding device 500 forms the needleless binding portion 550 at a position not to be pressed by the exit roll 333.

In addition, in order to suppress the staple needle to be deformed or the staple needle to cause the exit roll 333 to be damaged when the exit roll 333 presses against the needle binding portion 410 bound by the stapler 400, in the binding unit 320 according to the exemplary embodiment, the stapler 400 forms the needle binding portion 410 at a position not to be pressed by the exit roll 333.

More specifically, in a case in which the needle binding portions 410 and the needleless binding portions 550 are formed in an even number in the width direction (y direction), the needle binding portions 410 and the needleless binding portions 550 are formed in the outside of the exit roll 333.

Hereinafter, more specifically, the position of the needle binding portion 410 and the position of the needleless binding portion 550 will be described.

Here, in description hereinafter, an end portion of a center side in a width direction (y direction) in the needle binding portion 410 is referred to as a "needle binding portion inner end 410*i*", and an end portion of the outside is referred to as a "needle binding portion outer end 410*o*". In addition, an end portion of a center side in a width direction (y direction) in the needleless binding portion 550 is referred to as a "needleless binding portion inner end 550*i*", an end portion of the outside is referred to as a "needleless binding portion outer end 550*o*". In addition, an end portion of a center side of the exit roll 333 is referred to as a "roll inner end 333*i*", and an end portion of the outside is referred to as a "roll outer end 333*o*".

For example, in a case in which two needle binding portions 410 are formed in the width direction (y direction) of the paper bundle B, a center position 410*c* of the needle binding portion inner ends 410*i* of the two needle binding portions 410 is formed to be equal to a center position Bc of the paper bundle B, and the center position 410*c* of the two needle binding portion inner ends 410*i* is formed to be equal to a center position 333*c* between the roll inner ends 333*i* of the two exit rolls 333. Also, a distance L410*i* between the two needle binding portion inner ends 410*i* is formed to be longer than the distance L333*o* between the roll outer ends 333*o* of the two exit rolls 333.

Accordingly, in the binding unit 320 according to the exemplary embodiment, in a case in which the two needle binding portions 410 are formed in the width direction of the paper bundle B, each needle binding portion 410 is formed on the outside of each exit roll 333.

Also, in a case in which two needleless binding portions 550 are formed in the width direction (y direction) of the paper bundle B, a distance ΔLp between the needleless binding portion inner end 550*i* of each needleless binding portion 550 and the roll outer end 333*o* of each exit roll 333 is formed to be equal to or longer than a distance ΔLs between the needle binding portion inner end 410*i* of each needle binding portion 410 and the roll outer end 333*o* of each exit roll 333. Accordingly, in a case in which the two needleless binding portion 550 are formed in the width direction of the paper bundle B, even when a length of the width direction of the needleless binding portion 550 is longer than a length of the needle binding portion 410, each needleless binding portion 550 is more accurately formed on the outside of the exit roll 333. Therefore, generation of looseness or peeling on the needleless binding portion 550 due to the pressing force received from the exit roll 333 is suppressed. As a result, the paper P constituting the paper bundle B may be difficult to be peeled off from the paper bundle B. In addition, a center position 550*c* of the needleless binding portion inner ends 550*i* of the two needleless binding portions 550 may be formed to be equal to the center position Bc of the paper bundle B. Accordingly, an appearance of the paper bundle B which is bound by the two needleless binding portions 550 becomes good-looking.

Figure 8A:
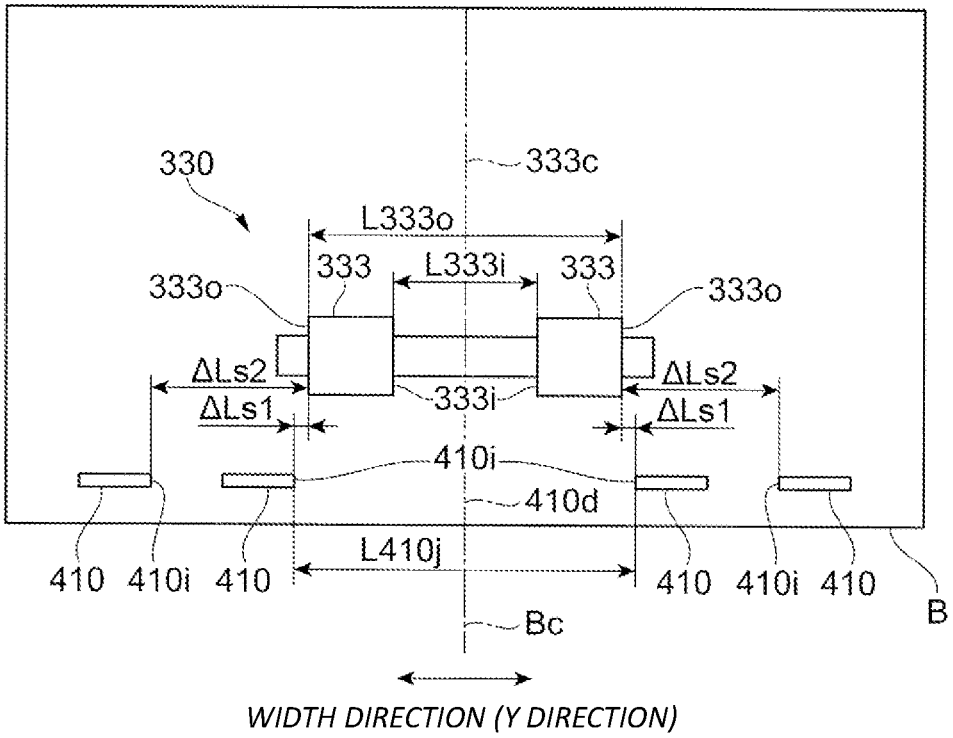
FIG. 8A is a view illustrating a position of the needle binding portion in a case in which the plural needle binding portions are formed in one direction and another direction of a width direction from a center position of the paper bundle.
Figure 8B:
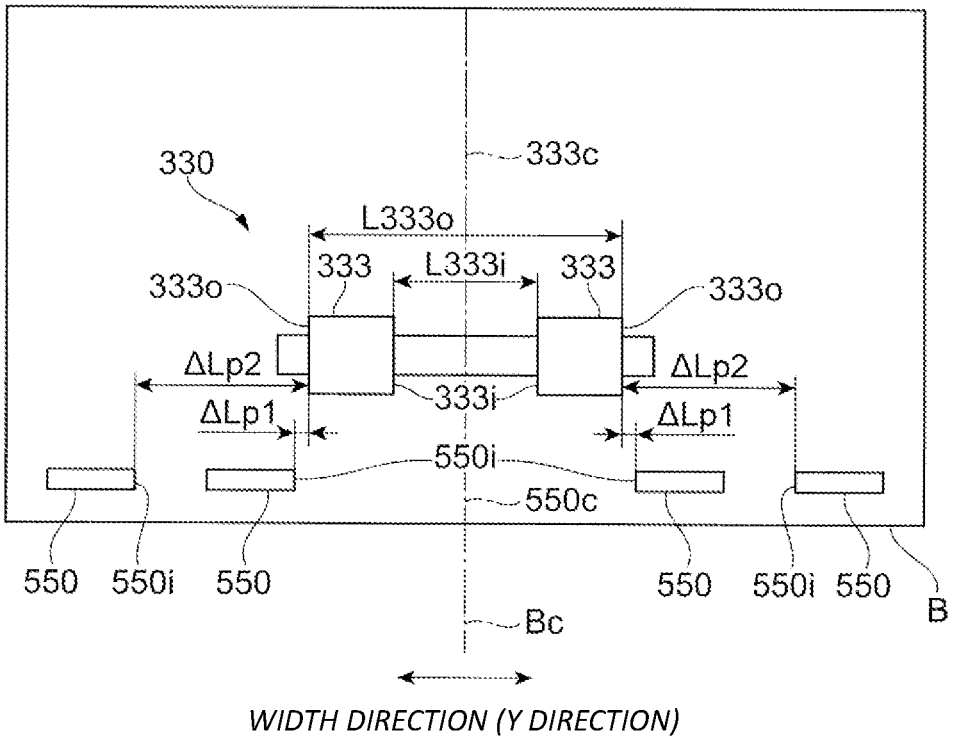
FIG. 8B is a view illustrating a position of the needleless binding portion in a case in which the plural needle binding portions and the needleless binding portions are formed in one direction and another direction of the width direction from the center position of the paper bundle.

FIG. 8A is a view illustrating a position of the needle binding portion 410 in a case in which the plural needle binding portions 410 are formed in one or another direction of the width direction (y direction) from the center position Bc of the paper bundle B. FIG. 8B is a view illustrating a position of the needleless binding portion 550 in a case in which the plural needleless binding portions 550 are formed in one or another direction of the width direction (y direction) from the center position Bc of the paper bundle B.

In a case in which the plural needle binding portions 410 are formed in one or another direction of the width direction (y direction) from the center position Bc of the paper bundle B, as illustrated in FIG. 8A, the plural needle binding portions 410 formed in one direction and the plural needle binding portions 410 formed in another direction are symmetric with respect to the center position Bc of the paper bundle B as a boundary. In addition, a center position 410*d* of the needle binding portion inner ends 410*i* of the two needle binding portions 410 closer to the center is formed to be equal to the center position 333*c* between the roll outer ends 333*o* of the two exit rolls 333, and a distance L410*j* between the needle binding portion inner ends 410*i* of the two needle binding portions 410 closer to the center is formed to be longer than the distance L333*o* between the roll outer ends 333*o* of the two exit rolls 333.

In a case in which the plural needleless binding portions 550 are formed in one or another direction of the width direction (y direction) from the center position Bc of the paper bundle B, as illustrated in FIG. 8B, an average distance (=(ΔLp1+ . . . +ΔLpn)/n) from the roll outer end 333*o* of each exit roll 333 to the needleless binding portion inner end 550*i* of the plural needleless binding portions 550 may be equal to or longer than an average distance (=(ΔLs1+ . . . +ΔLsn)/n) from the roll outer end 333*o* of each exit roll 333 to the needle binding portion inner end 410*i* of the plural needle binding portions 410. Accordingly, in a case in which the plural needleless binding portions 550 are formed in one direction from the center position Bc of the paper bundle B, even when the length of the width direction of the needleless binding portion 550 is formed to be longer than the length of the needle binding portion 410, all the needleless binding portions 550 are more accurately formed on the outside of the exit roll 333. Therefore, generation of looseness or peeling on the needleless binding portion 550 due to the pressing force received from the exit roll 333 is suppressed. As a result, the paper P constituting the paper bundle B may be difficult to be peeled off from the paper bundle B. In addition, the plural needleless binding portions 550 formed in one direction and the plural needleless binding portions 550 in another direction are symmetric with respect to the center position Bc of the paper bundle B as a boundary. Accordingly, the appearance of the paper bundle B which is bound by the two needleless binding portions 550 becomes good-looking.

Also, in a case in which three or more needle binding portions 410 are formed in one direction and another direction from the center position Bc of the paper bundle B, the other two or more needle binding portions 410 may be formed at an equal interval from the needle binding portion 410 closest to the center. In the same way, in a case in which three or more needleless binding portions 550 are formed in one direction and another direction from the center position Bc of the paper bundle B, the other two or more needleless binding portions 550 from the needleless binding portion 550 closest to the center may be formed at an equal interval. Accordingly, the appearance of the paper bundle B which is bound by the two needleless binding portions 550 becomes good-looking.

In addition, if the needle binding portion 410 and the needleless binding portion 550 may be formed on the outside of the exit roll 333, the center position 410*c* (410*d*) of the needle binding portion inner ends 410*i* of the needle binding portions 410 and the center position 550*c* of the needleless binding portion inner ends 550*i* of the needleless binding portions 550 may not be necessarily equal to the center position 333*c* between the roll inner ends 333*i* of the exit roll 333.

The example described above indicates a case in which the needle binding portions 410 and the needleless binding portions 550 are formed in an even number in the width direction (y direction), but in a case in which the needle binding portions 410 and the needleless binding portions 550 are formed in an odd number in the width direction (y direction), the needle binding portions and the needleless binding portions may be formed on positions to be described later. That is, one needle binding portion 410 and one needleless binding portion 550 may be formed at the center position Bc of the paper bundle B, and the remaining needle binding portions 410 and the needleless binding portions 550 in an even number may be formed on the outside of the exit roll 333 in the same way of the example of the even number described above. Accordingly, when the lengths of the width direction (y direction) of the needle binding portion 410 and the needleless binding portion 550 are set to be shorter than a distance L333*i* between the roll inner ends 333*i* of the exit roll 333, all the needle binding portions 410 and the needleless binding portions 550 are formed at a position not to be pressed by the exit roll 333. As a result, generation of looseness or peeling on the needleless binding portion 550 due to the pressing force received from the exit roll 333 is suppressed, and thus the paper P constituting the paper bundle B is difficult to be peeled off from the paper bundle B.

<First Modification Example of Position of Binding Portion >

Figure 9A:
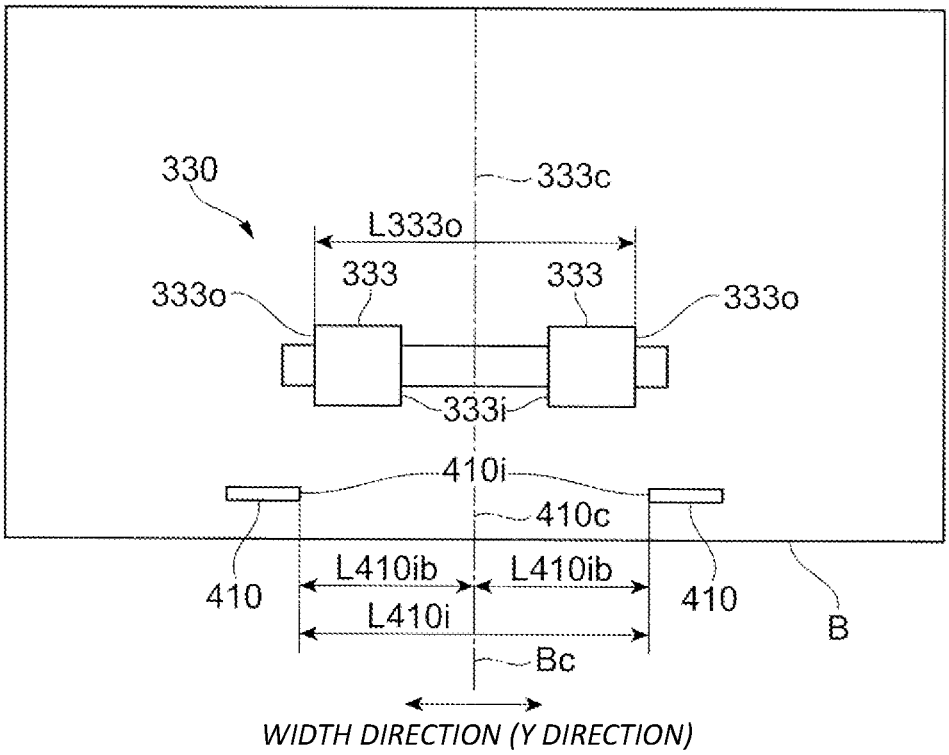
FIG. 9A is a view illustrating a first modification example of the position of the needle binding portion.
Figure 9B:
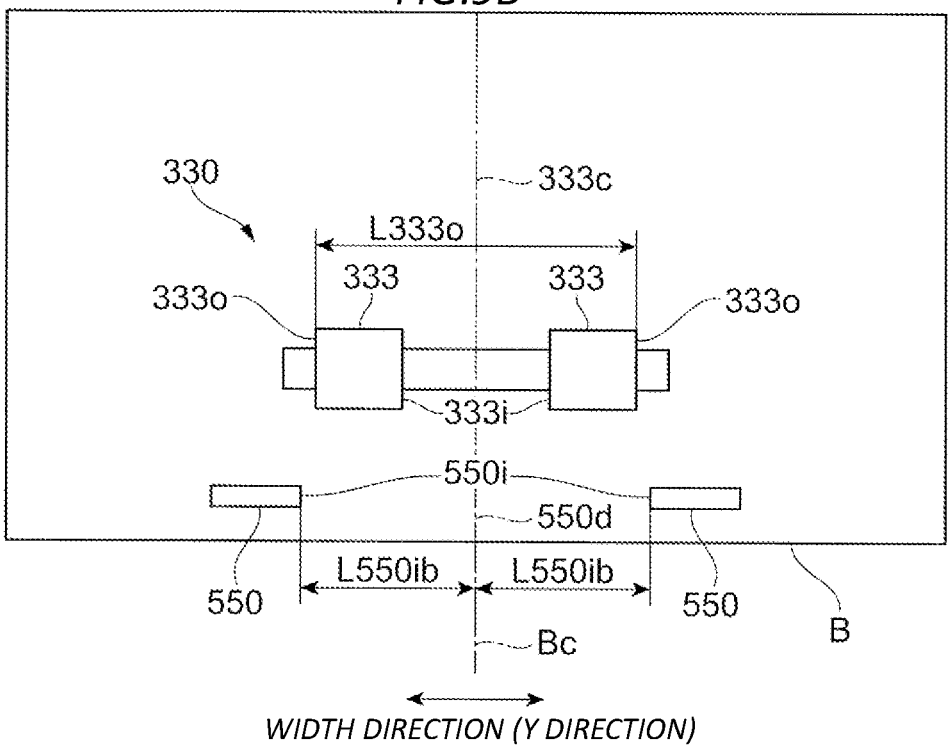
FIG. 9B is a view illustrating a first modification example of a position of the needleless binding portion.

FIG. 9A is a view illustrating a first modification example of a position of the needle binding portion 410. FIG. 9B is a view illustrating the first modification example of a position of the needleless binding portion 550.

In a case in which the two needle binding portions 410 are formed in the width direction (y direction) of the paper bundle B, as illustrated in FIG. 9A, the center position 410*c* of the needle binding portion inner ends 410*i* of the two needle binding portions 410 is formed to be equal to the center position Bc of the paper bundle B, and the center position 410*c* of the needle binding portion inner ends 410*i* of the two needle binding portions 410 is formed to be equal to the two center positions 333*c* between the roll inner ends 333*i* of the exit roll 333. Also, the distance L410*i* between the needle binding portion inner ends 410*i* of the two needle binding portions 410 is formed to be longer than the distance L333*o* between the roll outer ends 333*o* of the two exit rolls 333. This point is the same as that of the exemplary embodiment described above.

Also, in a case in which the two needleless binding portions 550 are formed in the width direction (y direction) of the paper bundle B in the first modification example, the center position 550*d* of the needleless binding portion inner ends 550*i* of the two needleless binding portions 550 is formed to be equal to the center position Bc of the paper bundle B, and a distance L550*ib* between the needleless binding portion inner end 550*i* of each needleless binding portion 550 and the center position Bc of the paper bundle B is equal to or longer than a distance L410*ib* between the needle binding portion inner end 410*i* of the needle binding portion 410 and the center position Bc of the paper bundle B. Accordingly, in a case in which the two needleless binding portions 550 are formed in the width direction (y direction) of the paper bundle B, even when the length of the width direction of the needleless binding portion 550 is set to be longer than the length of the needle binding portion 410, each needleless binding portion 550 is more accurately formed on the outside of the exit roll 333. Therefore, generation of looseness or peeling on the needleless binding portion 550 due to the pressing force received from the exit roll 333 is suppressed. As a result, the paper P constituting the paper bundle B is difficult to be peeled off from the paper bundle B.

Figure 10A:
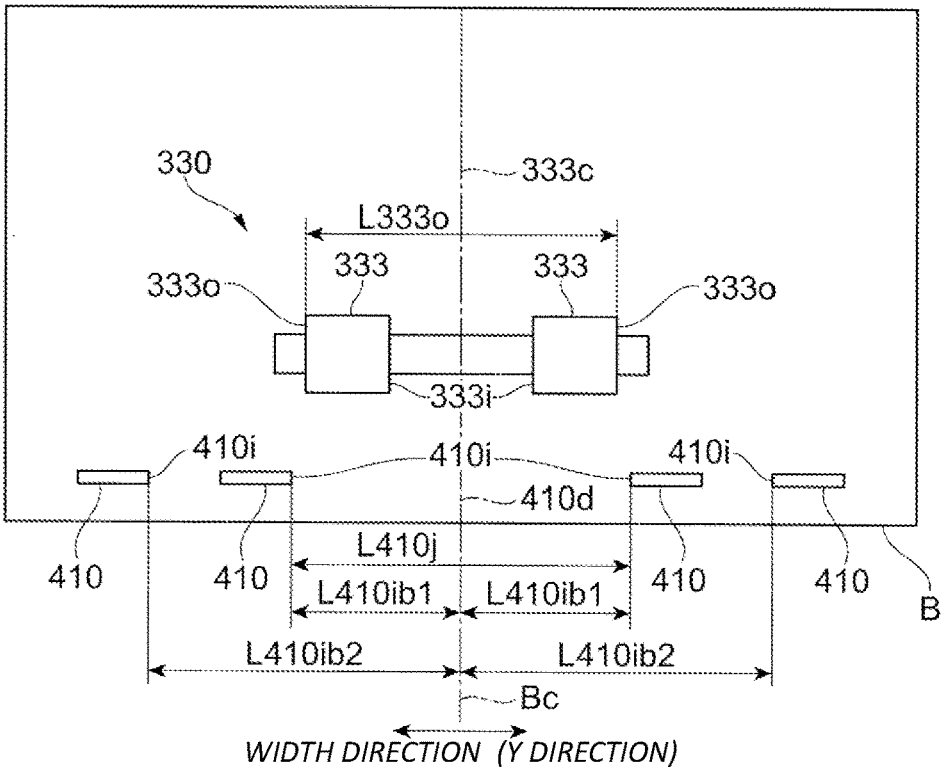
FIG. 10A is a view illustrating a first modification example of the position of the needle binding portion in a case in which the plural needle binding portions are formed in one direction and another direction of the width direction from the center position of the paper bundle.
Figure 10B:
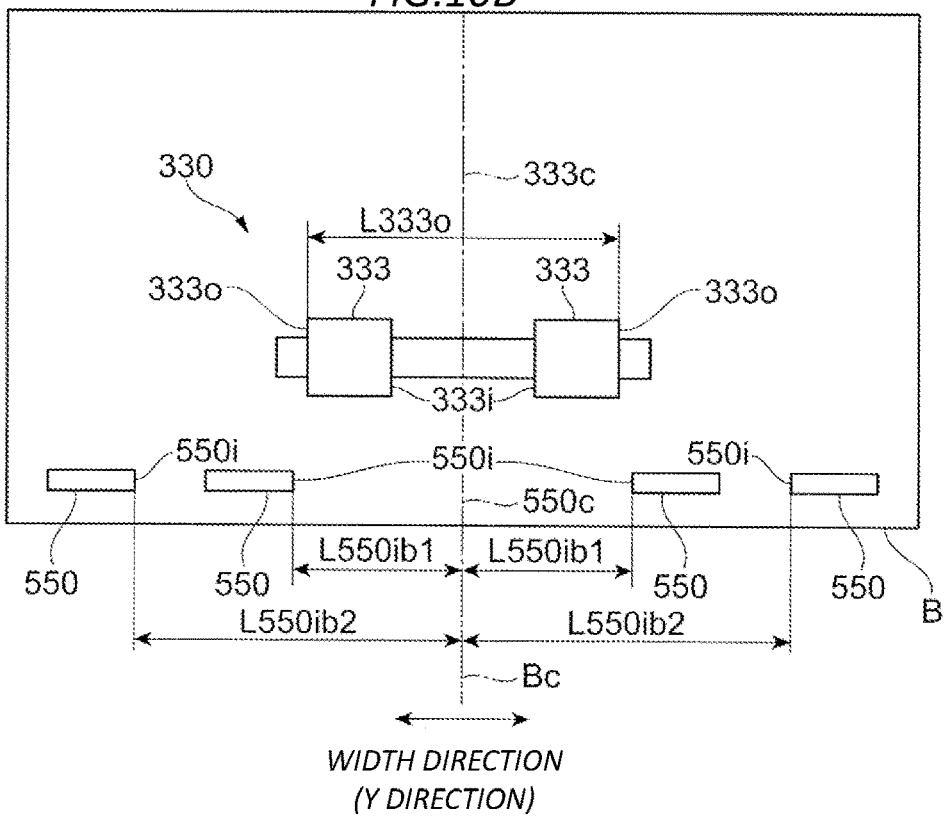
FIG. 10B is a view illustrating a first modification example of the position of the needleless binding portion in a case in which the plural needleless binding portions are formed in one direction and another direction of the width direction from the center position of the paper bundle.

FIG. 10A is a view illustrating the first modification example of the position of the needle binding portion 410, in a case in which the plural needle binding portions 410 are formed in one or another direction of the width direction (y direction) from the center position Bc of the paper bundle B. FIG. 10B is a view illustrating the first modification example of the position of the needleless binding portion 550 in a case in which the plural needleless binding portions 550 are formed in one or another direction of the width direction (y direction) from the center position Bc of the paper bundle B.

As illustrated in FIG. 10A, in a case in which the plural needle binding portions 410 are formed in one or another direction of the width direction (y direction) from the center position Bc of the paper bundle B, the plural needle binding portions 410 formed in one direction and the plural needle binding portions 410 formed in another direction are symmetric with respect to the center position Bc of the paper bundle B as a boundary. In addition, the center position 410*d* of the needle binding portion inner ends 410*i* of the two needle binding portions 410 closer to the center is formed to be equal to the center position 333*c* between the roll outer ends 333*o* of the two exit rolls 333, and the distance L410*j* between the needle binding portion inner ends 410*i* of the two needle binding portions 410 closer to the center is formed to be longer than the distance L333*o* between the roll outer ends 333*o* of the two exit rolls 333.

As illustrated in FIG. 10B, in a case in which the plural needleless binding portions 550 are formed in one or another direction of the width direction (y direction) from the center position Bc of the paper bundle B, an average distance (=(L550*ib*1+ . . . +L550*ibn*)/n) from the center position Bc of the paper bundle B to the needleless binding portion inner ends 550*i* of the plural needleless binding portions 550 formed in one or another direction of the width direction (y direction) may be equal to or longer than an average distance (=(L410*ib*1+ . . . +L410*ibn*)/n) from the center position Bc of the paper bundle B to the needle binding portion inner ends 410*i* the plural needle binding portions 410 formed in one direction of the width direction (y direction). Accordingly, in a case in which the plural needleless binding portions 550 are formed in one direction from the center position Bc of the paper bundle B, even when the length of the width direction (y direction) of the needleless binding portion 550 is set to be longer than the length of the needle binding portion 410, all the needleless binding portions 550 are more accurately formed on the outside of the exit roll 333. Therefore, generation of looseness or peeling on the needleless binding portion 550 due to the pressing force received from the exit roll 333 is suppressed. As a result, the paper P constituting the paper bundle B is difficult to be peeled off from the paper bundle B. In addition, the plural needleless binding portions 550 formed in one direction and the plural needleless binding portions 550 formed in another direction may be symmetric with respect to the center position Bc of the paper bundle B as a boundary. Accordingly, the appearance of the paper bundle B which is bound by the plural needleless binding portions 550 becomes good-looking.

Also, in a case in which the three or more needle binding portions 410 and needleless binding portions 550 are formed in one direction or another direction from the center position Bc of the paper bundle B, the other two or more needle binding portions 410 and needleless binding portions 550 from the needle binding portions 410 and the needleless binding portions 550 closest to the center may be formed at an equal interval.

In addition, in a case in which the needle binding portions 410 and the needleless binding portions 550 are formed in an odd number in the width direction (y direction), one needle binding portion 410 and one needleless binding portion 550 may be formed at the center position Bc of the paper bundle B, and the remaining needle binding portions 410 and needleless binding portions 550 in an even number may be formed in the same way as the example of the even number described above. Accordingly, all the needle binding portions 410 and needleless binding portions 550 are formed at a position not to be pressed by the exit roll 333. As a result, generation of looseness or peeling on the needleless binding portion 550 due to the pressing force received from the exit roll 333 is suppressed, and the paper P constituting the paper bundle B is difficult to be peeled off from the paper bundle B.

<<Second Modification Example of Position of Binding Portion>>

Figure 11A:
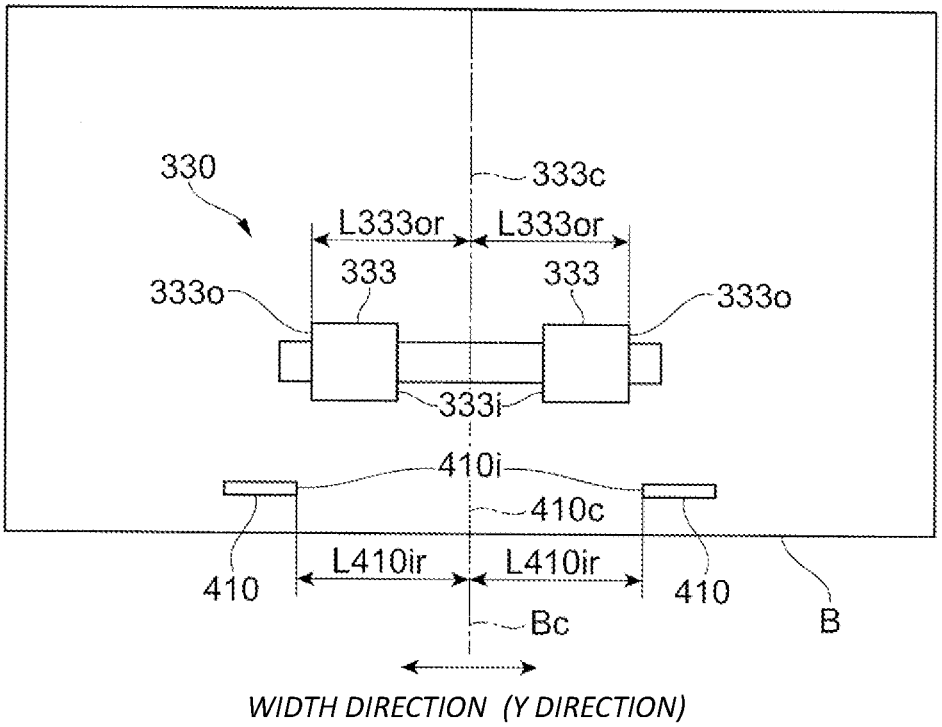
FIG. 11A is a view illustrating a second modification example of the position of the needle binding portion.
Figure 11B:
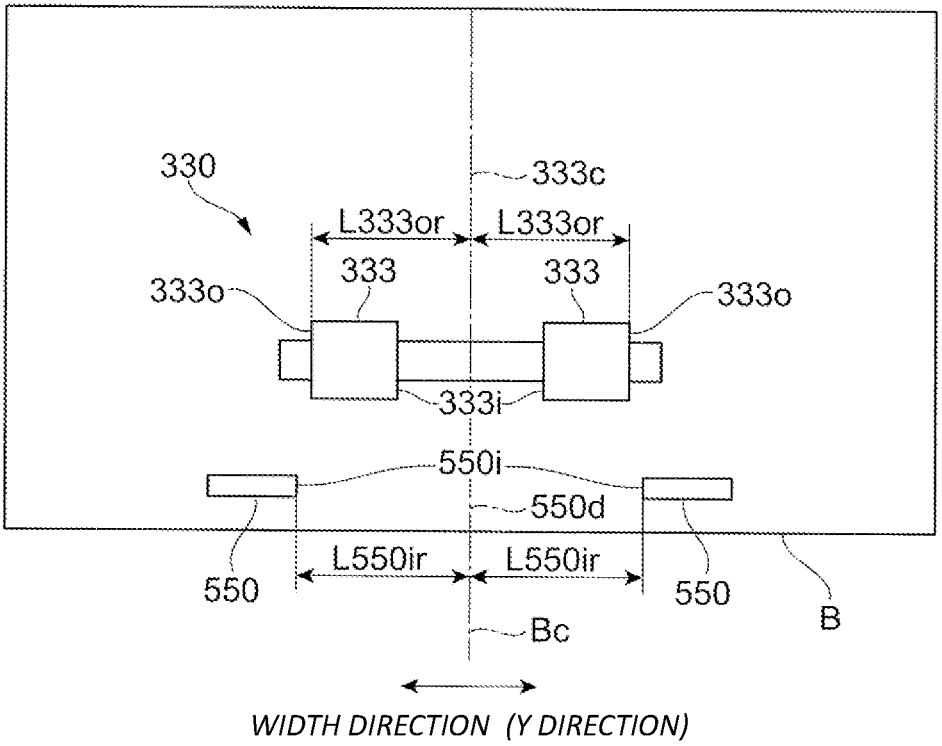
FIG. 11B is a view illustrating a second modification example of the position of the needleless binding portion.

FIG. 11A is a view illustrating a second modification example of the position of the needle binding portion 410. FIG. 11B is a view illustrating a second modification example of the position of the needleless binding portion 550.

In a case in which two needle binding portions 410 are formed in the width direction (y direction) of the paper bundle B, the center position 410*c* of the needle binding portion inner ends 410*i* of the two needle binding portions 410 is formed to be equal to the center position Bc of the paper bundle B, and the center position 410*c* of the needle binding portion inner ends 410*i* of the two needle binding portions 410 is formed to be equal to the center position 333*c* between the roll outer ends 333*o* (roll inner end 333*i*) of the two exit rolls 333. Also, a distance L410*ir* between the needle binding portion inner end 410*i* of each needle binding portion 410 and the center position 333*c* between the roll outer ends 333*o* of the exit roll 333 is formed to be longer than a distance L333*or* between the roll outer end 333*o* of each exit roll 333 and the center position 333*c* between the roll outer ends 333*o*.

Also, in a case in which the two needleless binding portions 550 are formed in the width direction (y direction) of the paper bundle B, a distance L550*ir* between the needleless binding portion inner end 550*i* of each needleless binding portion 550 and the center position 333*c* between the roll outer ends 333*o* of the exit rolls 333 is formed to be equal to or longer than the distance L410*ir* between the needle binding portion inner end 410*i* of each needle binding portion 410 and the center position 333*c* between the roll outer ends 333*o* of the exit rolls 333. Accordingly, in a case in which two needleless binding portions 550 are formed in the width direction of the paper bundle B, even when the length of the width direction of the needleless binding portion 550 is set to be longer than the length of the needle binding portion 410, each needleless binding portion 550 is more accurately formed on the outside of the exit roll 333. Therefore, generation of looseness or peeling on the needleless binding portion 550 due to the pressing force received from the exit roll 333 is suppressed. As a result, the paper P constituting the paper bundle B is difficult to be peeled off from the paper bundle B.

Figure 12A:
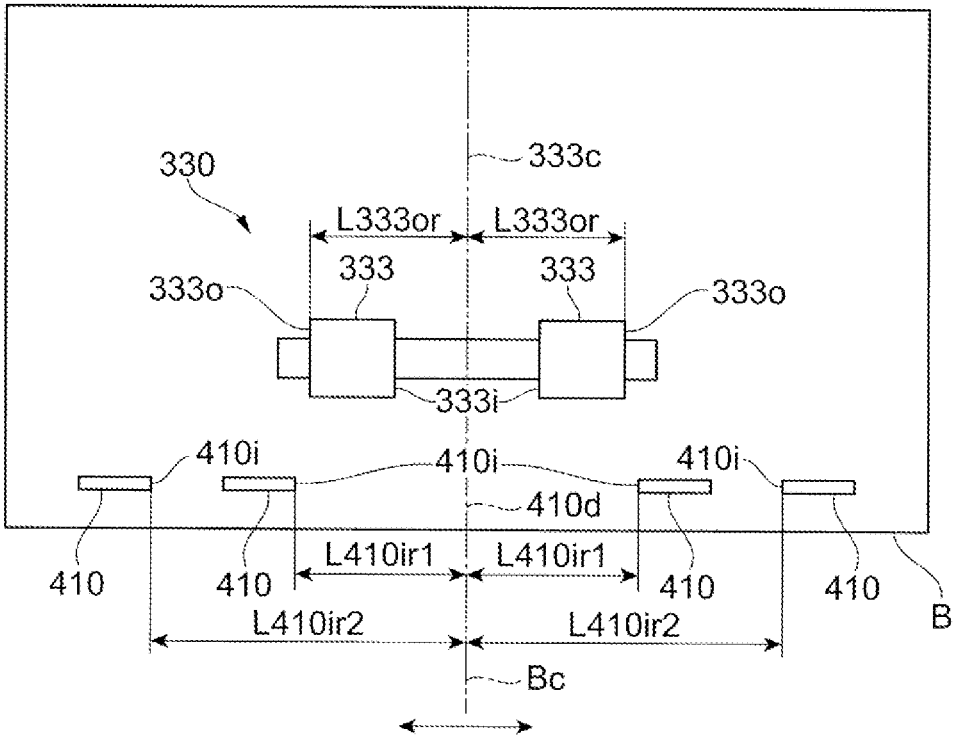
FIG. 12A is a view illustrating a second modification example of the position of the needle binding portion in a case in which the plural needle binding portions are formed in one direction and another direction of the width direction from the center position of the paper bundle.
Figure 12B:
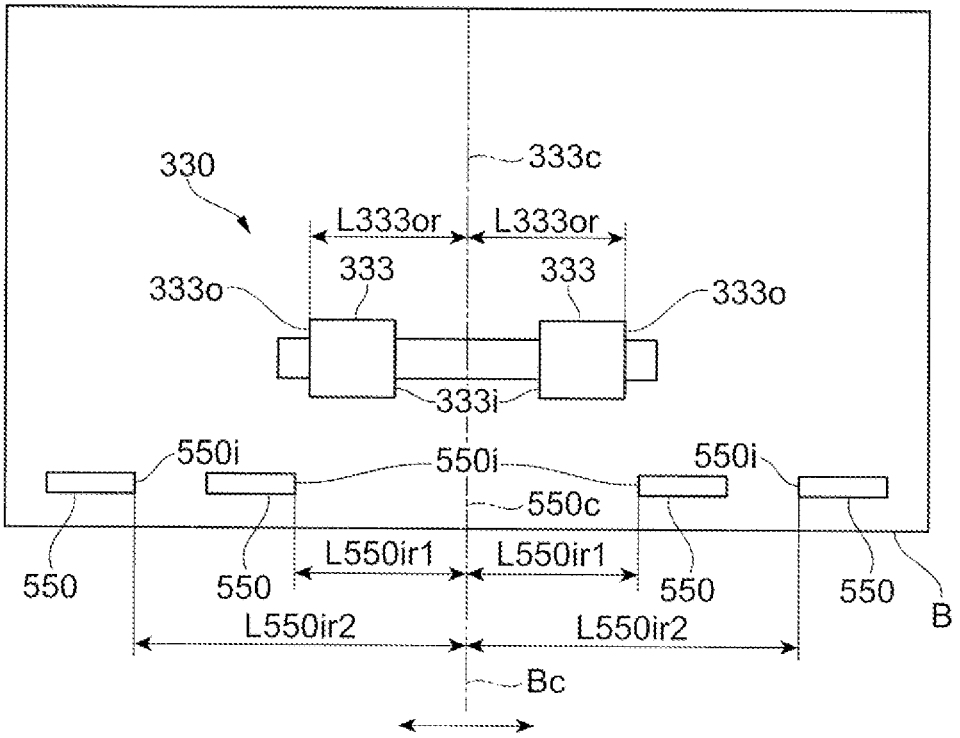
FIG. 12B is a view illustrating a second modification example of the position of the needleless binding portion in a case in which the plural needleless binding portions are formed in one direction and another direction of the width direction from the center position of the paper bundle.

FIG. 12A is a view illustrating the second modification example of the position of the needle binding portion 410 in a case in which the plural needle binding portions 410 are formed in one or another direction of the width direction (y direction) from the center position of the paper bundle. FIG. 12B is a view illustrating the second modification example of the position of the needleless binding portion 550, in a case in which the plural needleless binding portions 550 are formed in one or another direction of the width direction (y direction) from the center position of the paper bundle.

In a case in which the plural needle binding portions 410 are formed in one or another direction of the width direction (y direction) from the center position Bc of the paper bundle B, as illustrated in FIG. 12A, the plural needle binding portions 410 formed in one direction and the plural needle binding portions 410 formed in another direction are symmetric with respect to the center position Bc of the paper bundle B as a boundary. In addition, the center position 410*d* of the needle binding portion inner ends 410*i* of the two needle binding portions 410 closer to the center is formed to be equal to the center position 333*c* between the roll outer ends 333*o* of the two exit rolls 333, and the distance L410*ir*1 between each needle binding portion inner end 410*i* of the two needle binding portions 410 closer to the center and the center position 333*c* between the roll outer ends 333*o* of the exit rolls 333 is formed to be longer than the distance L333*or* between the roll outer end 333*o* of each exit roll 333 and the center position 333*c* between the roll outer ends 333*o*.

In a case in which the plural needleless binding portions 550 are formed in one or another direction of the width direction (y direction) from the center position Bc of the paper bundle B, as illustrated in FIG. 12B, an average distance (=(L550*ir*1+ . . . +L550*irn*)/n) from the center position 333*c* between the roll outer ends 333*o* of the exit rolls 333 to the needleless binding portion inner end 550*i* of the plural needleless binding portions 550 formed in one direction of the width direction (y direction) may be equal to or longer than an average distance (=(L410*ir*1+ . . . +L410*irn*)/n) from the center position 333*c* between the roll outer ends 333*o* to the needle binding portion inner end 410*i* of the plural needle binding portions 410 formed in one direction of the width direction (y direction). Accordingly, in a case in which the plural needleless binding portions 550 are formed in one direction from the center position Bc of the paper bundle B, even when the length of the width direction of the needleless binding portion 550 is set to be longer than the length of the needle binding portion 410, all the needleless binding portions 550 are more accurately formed on the outside of the exit roll 333. Therefore, generation of looseness or peeling on the needleless binding portion 550 due to the pressing force received from the exit roll 333 is suppressed. As a result, the paper P constituting the paper bundle B is difficult to be peeled off from the paper bundle B. In addition, the plural needleless binding portions 550 formed in one direction and the plural needleless binding portions 550 formed in another direction may be symmetric with respect to the center position Bc of the paper bundle B as a boundary. Accordingly, the appearance of the paper bundle B bound by the plural needleless binding portions 550 becomes good-looking.

Also, in a case in which the three or more needle binding portions 410 and needleless binding portions 550 are formed in one direction or another direction from the center position Bc of the paper bundle B, the other two or more needle binding portions 410 and needleless binding portions 550 from the needle binding portions 410 and the needleless binding portions 550 closest to the center may be formed at an equal interval.

In addition, in a case in which the needle binding portions 410 and the needleless binding portions 550 are formed in an odd number in the width direction (y direction), one needle binding portion 410 and one needleless binding portion 550 are formed at the center position Bc of the paper bundle B, and the remaining needle binding portions 410 and needleless binding portions 550 in an even number may be formed in the same way as an example of the even number described above. Accordingly, all the needle binding portions 410 and needleless binding portions 550 are formed at a position not to be pressed by the exit roll 333. As a result, generation of looseness or peeling on the needleless binding portion 550 due to the pressing force received from the exit roll 333 is suppressed, and the paper P constituting the paper bundle B is difficult to be peeled off from the paper bundle B.

<Third Modification Example of Position of Binding Portion>

In a case in which two needle binding portions 410 are formed in the width direction (y direction) of the paper bundle B, the center position 410*c* of the needle binding portion inner ends 410*i* of the two needle binding portions 410 (refer to FIG. 7A) is formed to be equal to the center position Bc of the paper bundle B (refer to FIG. 7A), and the center position 410*c* of the needle binding portion inner ends 410*i* of the two needle binding portions 410 is formed to be equal to the two center positions 333*c* between the roll inner ends 333*i* of the exit roll 333 (refer to FIG. 7A). Also, the distance L410*i* between the needle binding portion inner ends 410*i* of the two needle binding portions 410 is formed to be longer than the distance L333*o* between the roll outer ends 333*o* of the two exit rolls 333. This point is the same as the exemplary embodiment described above.

Also, in a case in which the two needleless binding portions 550 are formed in the width direction (y direction)

of the paper bundle B, a distance L550*i* between the needleless binding portion inner ends 550*i* of the two needleless binding portions 550 (refer to FIG. 7B) is formed to be equal to or longer than the distance L410*i* between the needle binding portion inner ends 410*i* of the two needle binding portions 410 (refer to FIG. 7B). Accordingly, in a case in which two needleless binding portions 550 are formed in the width direction of the paper bundle B, even when the length of the width direction of the needleless binding portion 550 is longer than the length of the needle binding portion 410, each needleless binding portion 550 is more accurately formed on the outside of the exit roll 333. Therefore, generation of looseness or peeling on the needleless binding portion 550 due to the pressing force received from the exit roll 333 is suppressed. As a result, the paper P constituting the paper bundle B is difficult to be peeled off from the paper bundle B.

Figure 13A:
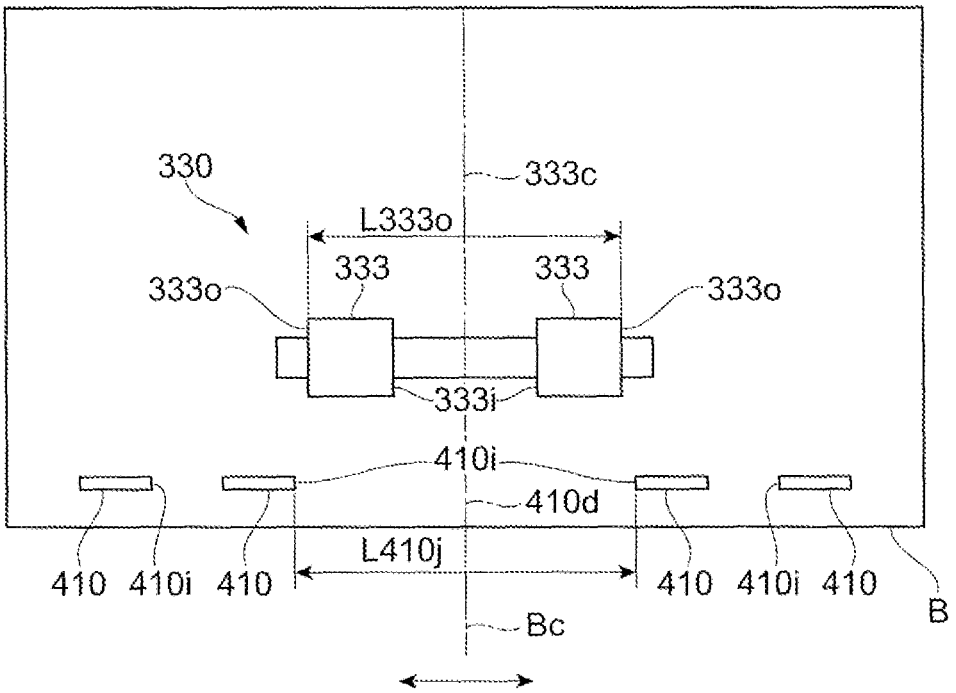
FIG. 13A is a view illustrating a third modification example of a position of a needle binding portion in a case in which the plural needle binding portions are formed in one direction and another direction of the width direction from the center position of the paper bundle.
Figure 13B:
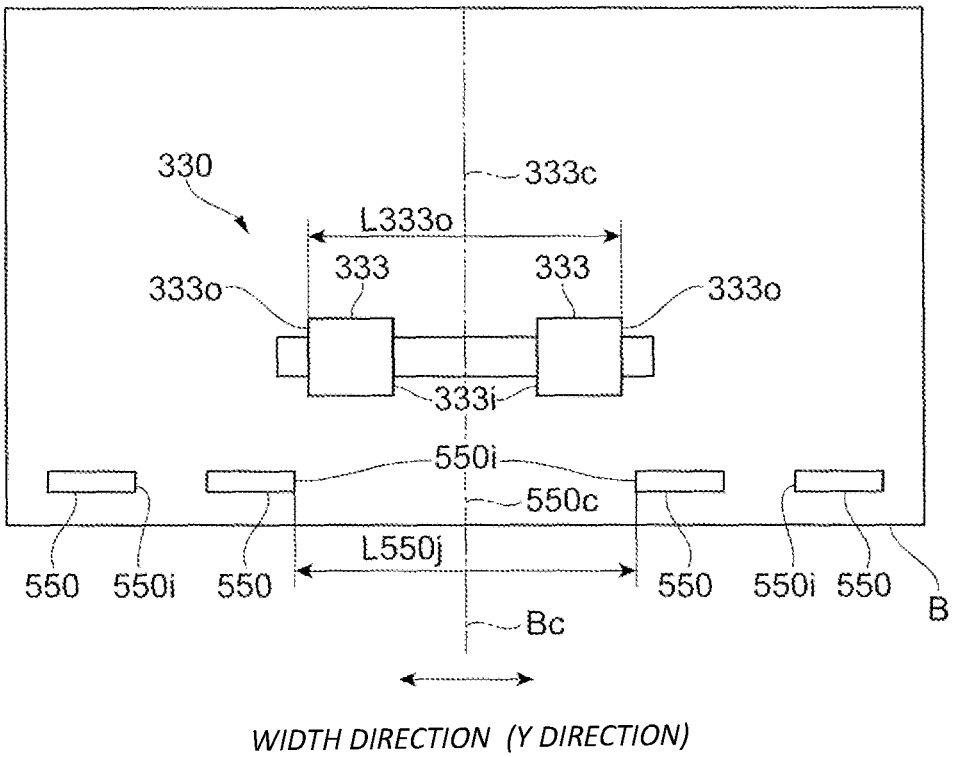
FIG. 13B is a view illustrating a third modification example of a position of a needleless binding portion in a case in which the plural needleless binding portions are formed in one direction and another direction of the width direction from the center position of the paper bundle.

FIG. 13A is a view illustrating the third modification example of the position of the needle binding portion 410, in a case in which the plural needle binding portions 410 are formed in one or another direction of the width direction (y direction) from the center position of the paper bundle. FIG. 13B is a view illustrating the third modification example of the position of the needleless binding portion 550, in a case in which the plural needleless binding portions 550 are formed in one or another direction of the width direction (y direction) from the center position of the paper bundle.

In a case in which the plural needle binding portions 410 are formed in one or another direction of the width direction (y direction) from the center position Bc of the paper bundle B, as illustrated in FIG. 13A, the plural needle binding portions 410 formed in one direction and the plural needle binding portions 410 formed in another direction are symmetric with respect to the center position Bc of the paper bundle B as a boundary. In addition, the center position 410*d* of the needle binding portion inner ends 410*i* of the two needle binding portions 410 closer to the center is formed to be equal to the center position 333*c* between the roll outer ends 333*o* of the two exit rolls 333, and the distance L410*j* between the needle binding portion inner ends 410*i* of the two needle binding portions 410 closer to the center is formed to be longer than the distance L333*o* between the roll outer ends 333*o* of the two exit rolls 333.

In a case in which the plural needleless binding portions 550 are formed in one or another direction of the width direction (y direction) from the center position Bc of the paper bundle B, as illustrated in FIG. 13A, a distance L550*j* between the needleless binding portion inner ends 550*i* of the two needleless binding portions 550 closer to the center, in the plural needleless binding portions 550 formed in one or another direction of the width direction (y direction) from the center position Bc of the paper bundle B is formed to be equal to or longer than the distance L410*j* between the needle binding portion inner ends 410*i* of the two needle binding portions 410 closer to the center. Accordingly, in a case in which the plural needleless binding portions 550 are formed in one direction or another direction from the center position Bc of the paper bundle B, even when the length of the width direction of the needleless binding portion 550 is set to be longer than the length of the needle binding portion 410, all the needleless binding portions 550 are more accurately formed on the outside of the exit roll 333. Therefore, generation of looseness or peeling on the needleless binding portion 550 due to the pressing force received from the exit roll 333 is suppressed. As a result, the paper P constituting the paper bundle B is difficult to be peeled off from the paper bundle B. In addition, the plural needleless binding portions 550 formed in one direction and the plural needleless binding portions 550 formed in another direction may be symmetric with respect to the center position Bc of the paper bundle B as a boundary. Accordingly, the appearance of the paper bundle B bound by the plural needleless binding portions 550 becomes good-looking.

Also, in a case in which the three or more needle binding portions 410 and needleless binding portions 550 are formed in one direction or another direction from the center position Bc of the paper bundle B, the other two or more needle binding portions 410 and needleless binding portions 550 from the needle binding portions 410 and the needleless binding portions 550 closest to the center may be formed at an equal interval.

In addition, in a case in which the needle binding portions 410 and the needleless binding portions 550 are formed in an odd number in the width direction (y direction), one needle binding portion 410 and one needleless binding portion 550 are formed at the center position Bc of the paper bundle B, the remaining needle binding portions 410 and needleless binding portions 550 in an even number may be formed in the same way as that of an example of the even number described above. Accordingly, all the needle binding portions 410 and needleless binding portions 550 are formed at a position not to be pressed by the exit roll 333. As a result, generation of looseness or peeling on the needleless binding portion 550 due to the pressing force received from the exit roll 333 is suppressed, and the paper P constituting the paper bundle B is difficult to be peeled off from the paper bundle B.

(Offset Operation)

An operation of offsetting and exiting the paper bundle B bound by the binding unit 320 will be described.

In the post-processing device 3 according to the exemplary embodiment, in order to easily distinguish one paper bundle B (or one group of paper bundles) from the other paper bundle B (or the other group of paper bundles) of the plural bound paper bundles B, or to increase the number of bundles of the paper bundles B which are stacked on the stacking portion 34, a user requires the device to perform an offset process. That is, the paper processing controller 33 receives information relating to the binding process and the offset process through a user interface (not illustrated) or the like. The paper processing controller 33 received the information relating to the binding process and the offset process determines a binding position, an amount of offsetting, or the like, with reference to a table or the like stored in a storage portion (not illustrated) such as a ROM. In the binding processing device 300 according to the exemplary embodiment, offsetting is performed in one or another direction of the width direction (y direction) from the center position Bc (refer to FIG. 14) of the paper bundle B.

In a case in which the offset process is performed, the paper processing controller 33 causes the moving side exit member 332 of the exit portion 330 to move (rises) in the arrow Q2 (refer to FIG. 2) direction after the binding unit 320 performs the binding process on the paper bundle B formed on the paper accumulating portion 310. After that, the paper processing controller 33 causes the first tamper 351 and the second tamper 352 to move to a position in accordance with a set amount of offsetting. Accordingly, the bound paper bundle B is deviated from in the width direction (y direction) of the paper bundle B (paper bundle B is offset).

Also, the paper processing controller 33 causes the moving side exit member 332 to move (go down) in the arrow Q1 direction after the position of the paper bundle B is moved (offset), and causes the paper bundle B to be pressed by the exit roll 333. The paper processing controller 33 rotates the exit roll 333 in a state in which the paper bundle B is pressed by the exit roll 333, and thus the paper bundle B is exited to the stacking portion 34.

Here, as described above, the stapler 400 of the binding unit 320 pushes the staple needle 401 in a thickness direction (z direction) of the paper P and causes an end portion of the staple needle 401 to be bent on the opposite side of the paper bundle B, and thus the paper bundle B is bound. Therefore, a height H410 of the needle binding portion of the needle binding portion 410 is higher than a height of the paper bundle B on which the binding process is not performed, due to a size or the bent portion of the end portion of the staple needle 401.

The needleless binding device 500 binds the paper bundle B by making deformation in the thickness direction (z direction) of the paper bundle B. Therefore, a height H550 of the needleless binding portion of the needleless binding portion 550 is higher than the height of the paper bundle B on which the binding process is not performed, due to deformation of the thickness direction (z direction).

As described above, since the height H410 of the needle binding portion and the height H550 of the needleless binding portion are higher than the height of the paper bundle B on which the binding process is not performed, the height of the entire paper bundles B on which the binding process is performed stacked on the stacking portion 34 is higher than the height of the entire paper bundles B on which the binding process is not performed. As a result, the number of bundles of the paper bundle B which may be stacked on the stacking portion 34 is reduced, or a stacking stability of the entire paper bundles B may be deteriorated even when the bundles of the paper are stacked as the same number of bundles stack.

In consideration of the height H410 of the needle binding portion and the height H550 of the needleless binding portion, in the binding processing device 300 according to the exemplary embodiment, when the paper bundle B bound by the binding unit 320 is offset so as to be exited to the stacking portion 34, an amount of offsetting is determined as follows.

That is, when a first needle binding paper bundle Bs1 (refer to FIG. 14A) bound by the stapler 400 and a second needle binding paper bundle Bs2 (refer to FIG. 14B) bound by the stapler 400 are offset, offsetting is performed so that the needle binding portion 410 of the first needle binding paper bundle Bs1 and the needle binding portion 410 of the second needle binding paper bundle Bs2 do not overlap with each other. That is, an amount of offsetting M410 (refer to FIG. 14B) of the first needle binding paper bundle Bs1 and the second needle binding paper bundle Bs2 is set to be greater than the length L410 of the needle binding portion 410. Accordingly, the number of bundles of the paper bundle B which may be stacked on the stacking portion 34 is increased. In addition, a stacking stability of the entire paper bundles B is improved.

Also, with respect to the first needle binding paper bundle Bs1, in a case in which the second needle binding paper bundle Bs2 is offset in one direction or in another direction of the width direction (y direction) from the center position Bc of the paper bundle B, both the needle binding portions 410 of being offset in one direction and another direction may be required not to overlap with each other.

Meanwhile, since the height H550 of the needleless binding portion of the needleless binding portion 550 is shorter than the height H410 of the needle binding portion of the needle binding portion 410, when the paper bundle B bound by the needleless binding device 500 is offset, an amount of offsetting is determined as follows. That is, when a second needleless binding paper bundle Bp2 bound by the needleless binding device 500 (refer to FIG. 15B) is offset with respect to a first needleless binding paper bundle Bp1 bound by the needleless binding device 500 (refer to FIG. 15A), the needleless binding portion 550 of the first needleless binding paper bundle Bp1 and the needleless binding portion 550 of the second needleless binding paper bundle Bp2 are offset so as not to overlap with each other. That is, an amount of offsetting M550 of the first needleless binding paper bundle Bpi and the second needleless binding paper bundle Bp2 (refer to FIG. 15B) is set to be smaller than the length L550 of the needleless binding portion 550. This is because that, as described above, even when the length of the width direction (y direction) of the needleless binding portion 550 is longer than the lengths of the width direction (y direction) of the needle binding portion 410, the needleless binding portion 550 is formed at a position not to be pressed by the exit roll 333 as described later.

A relationship between the position of binding portion and the amount of offsetting will be described later in detail.

(Position of Binding Portion)

Figure 14A:
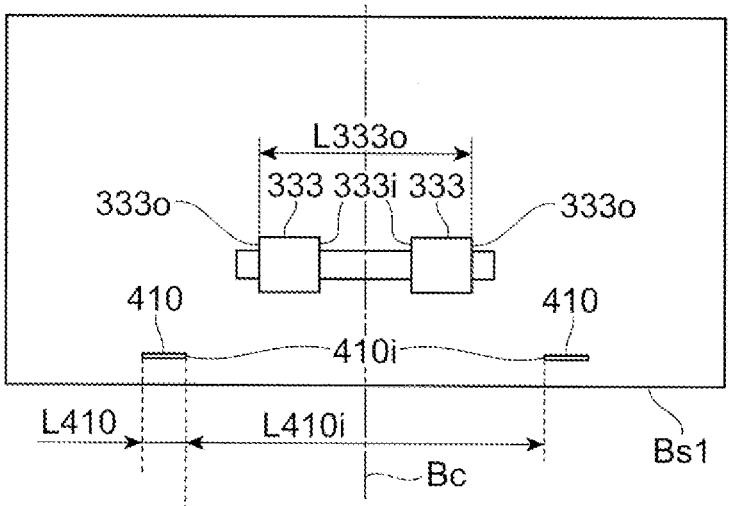
FIGS. 14A to 14C are views illustrating an aspect in which the paper bundle bound by a stapler is exited.
Figure 14B:
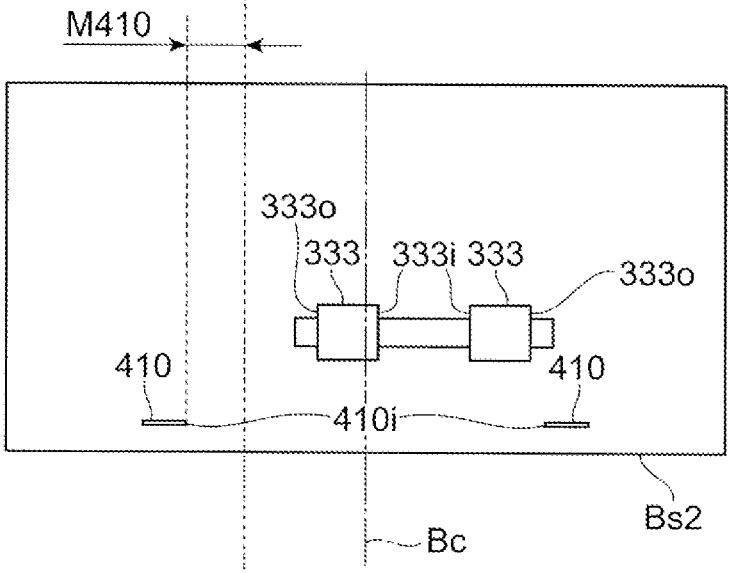
Figure 14C:
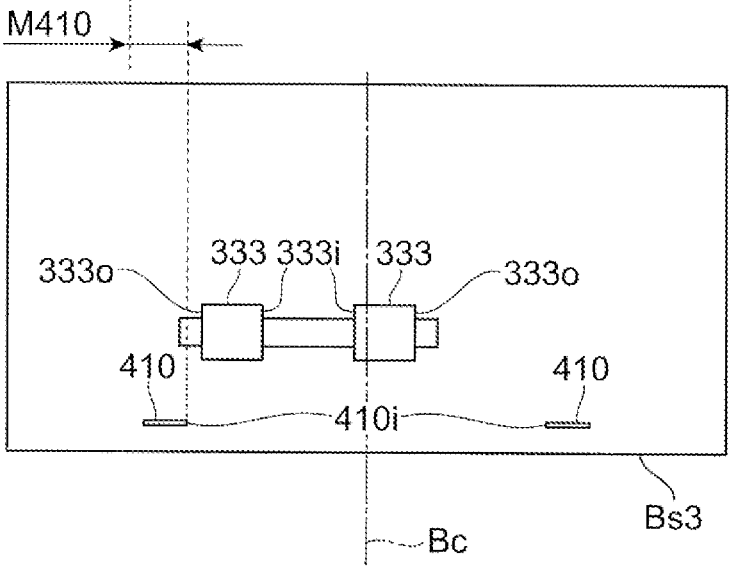

FIGS. 14A to 14C are views illustrating an aspect of exiting the paper bundle B bound by the stapler 400. FIG. 14A is a view illustrating an aspect of a case in which the paper bundle B is exited without being offset, FIG. 14B is a view illustrating an aspect of a case in which the paper bundle B is offset and exited in one direction, and FIG. 14C is a view illustrating an aspect of a case in which the paper bundle B is offset and exited in another direction.

Figure 15A:
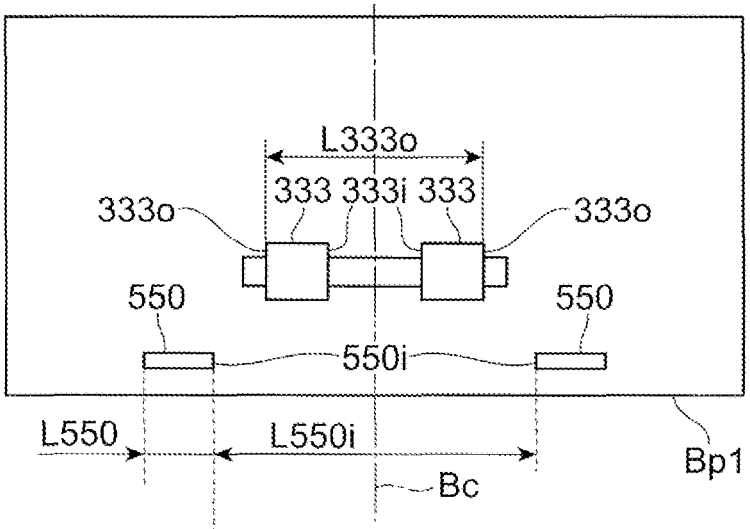
FIGS. 15A to 15C are views illustrating an aspect in which the paper bundle bound by the needleless binding device is exited.
Figure 15B:
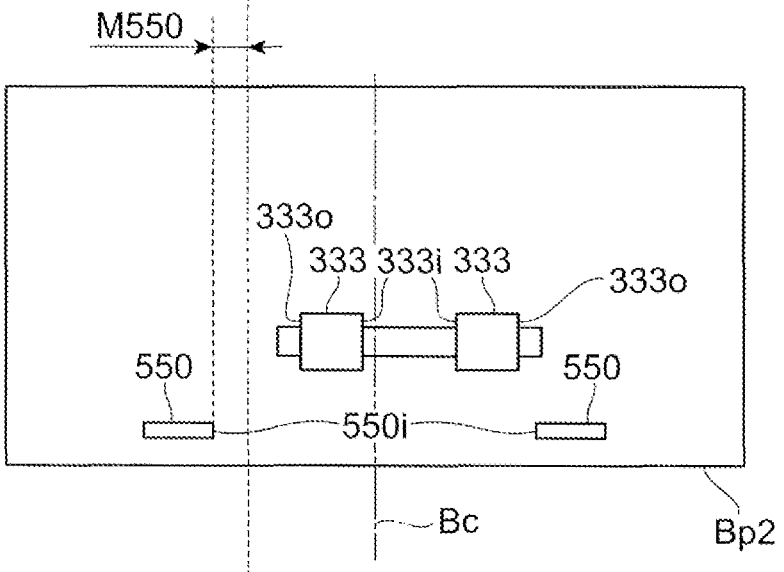
Figure 15C:
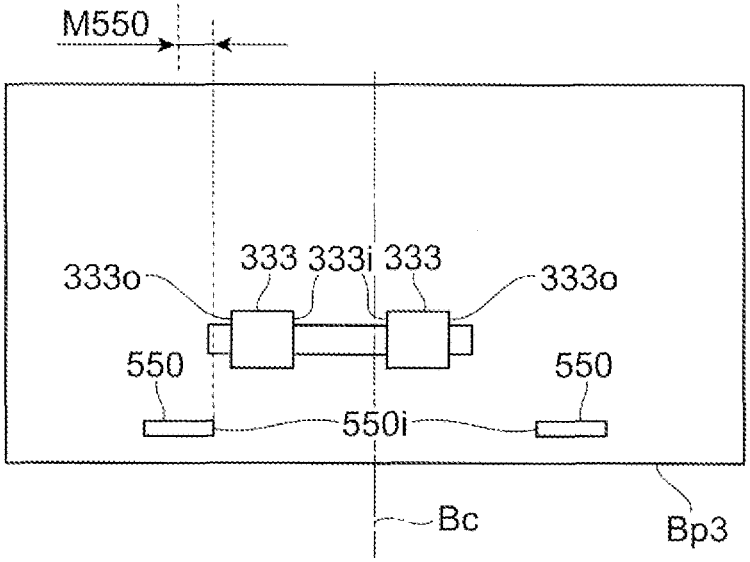

FIGS. 15A to 15C are views illustrating an aspect of exiting the paper bundle B bound by the needleless binding device 500. FIG. 15A is a view illustrating an aspect of a case in which the paper bundle B is exited without being offset, FIG. 15B is a view illustrating an aspect of a case in which the paper bundle B is offset and exited in one direction, and FIG. 15C is a view illustrating an aspect of a case in which the paper bundle B is offset and exited in another direction.

As illustrated in FIGS. 1 to 3, the exit roll 333 is disposed on a downstream side of the exit direction of a paper bundle (x direction) of the binding unit 320. If the binding unit 320 finishes to generate the paper bundle B, the exit roll 333 exits the paper bundle B to the stacking portion 34. Therefore, the paper bundle B on which the binding process is performed is pressed by the exit roll 333. Two exit rolls 333 (a pair of the fixing side exit roll 331*a* and the moving side exit roll 332*a*) are placed in the width direction (y direction) of the paper bundle B.

In order to suppress generation of looseness or peeling due to the pressing force received from the exit roll 333 on the needleless binding portion 550 bound by the needleless binding device 500, in the binding unit 320 of according to the exemplary embodiment, the needleless binding device 500 forms the needleless binding portions 550 at a position not to be pressed by the exit roll 333.

In addition, in order to suppress deformation of the staple needle 401 or causing the staple needle 401 to damage the exit roll 333 due to pressing against the needle binding portion 410, which is bound by the stapler 400, by the exit roll 333, in the binding unit 320 of according to the exemplary embodiment, the stapler 400 forms the needle binding portions 410 at a position not to be pressed by the exit roll 333.

For example, in a case in which the needle binding portions 410 and the needleless binding portions 550 are formed in an even number in the width direction (y direction), even when offsetting or not offsetting, the needle binding portions 410 and the needleless binding portions 550 are formed on the outside of the exit roll 333.

Hereinafter, more specifically, the position of the needle binding portion 410 and the position of the needleless binding portion 550 will be described.

Here, in description hereinafter, the end portion on the center side in the width direction (y direction) in the needle binding portion 410 is referred to as the "needle binding portion inner end 410*i*". In addition, the end portion on the center side in the width direction (y direction) in the needleless binding portion 550 is referred to as the "needleless binding portion inner end 550*i*". In addition, an end portion on a center side of the exit roll 333 is referred to as the "roll inner end 333*i*", and an end portion of the outside is referred to as the "roll outer end 333*o*".

In a case in which two needle binding portions 410 are formed in the width direction (y direction) of the paper bundle B, even when the paper bundle B with the binding portion 410 formed thereon is offset and exited or is exited without being offset (refer to FIG. 14A), the two needle binding portions 410 are formed to be positioned on the outside of the exit roll 333. In addition, even when offsetting is performed in one direction of the width direction (y direction) (refer to FIG. 14B) or in another direction (refer to FIG. 14C) from the center position Bc of the paper bundle B, the two needle binding portions 410 are formed to be positioned on the outside of the exit roll 333. Therefore, the position and the amount of offsetting M410 of the needle binding portion 410 are set, such that a value obtained by subtracting an amount of offsetting M410 in both directions from the distance L410*i* between the two needle binding portion inner ends 410*i* is greater than the distance L333*o* between the roll outer ends 333*o* of the two exit rolls 333. That is, the distance L410*i* and the amount of offsetting M410 are set to be a value satisfying Expression (1) as follows.

$$L410i-2\times M410>L333o \quad (1)$$

Also, as described above, the amount of offsetting M410 is greater than the length L410 of the needle binding portion 410 (M410>L410).

Accordingly, while the needle binding portion 410 is not pressed by the exit roll 333, a stacked height of the plurality of paper bundles B is suppressed.

Also, the two needle binding portions 410 are symmetric with respect to the center position Bc of the paper bundle B as a boundary. Accordingly, an appearance of the paper bundle B bound by the two needle binding portions 410 becomes good-looking.

In a case in which the two needleless binding portions 550 are formed in the width direction (y direction) of the paper bundle B, even when the paper bundle B with the needleless binding portion 550 formed thereon is offset and exited or is exited without not being offset (refer to FIG. 15A), the needleless binding portion 550 is formed to be positioned on the outside of the exit roll 333. In addition, even when offsetting is performed in one direction of the width direction (y direction) (refer to FIG. 15B) or in another direction (refer to FIG. 15C) from the center position Bc of the paper bundle B, the needleless binding portion 550 is formed to be positioned on the outside of the exit roll 333. Therefore, the position and the amount of offsetting M550 of the needleless binding portion 550 are set, such that a value obtained by subtracting the amount of offsetting M550 in both directions from the distance L550*i* between the two needleless binding portion inner ends 550*i* is greater than the distance L333*o* between the roll outer ends 333*o* of the two exit rolls 333. That is, the distance L550*i* and the amount of offsetting M550 are set to a value satisfying Expression (2) as follows.

$$L550i-2\times M550>L333o \quad (2)$$

Here, as described above, in terms of a stacking ability in the stacking portion 34, it is preferable that offsetting be performed so that the needleless binding portion 550 of the first needleless binding paper bundle Bp1 and the needleless binding portion 550 of the second needleless binding paper bundle Bp2 which is offset in one direction of the width direction (y direction) from the center position Bc of the paper bundle B do not overlap with each other. In addition, it is preferable that offsetting be performed so that the needleless binding portion 550 of the first needleless binding paper bundle Bp1 and the needleless binding portion 550 of a third needleless binding paper bundle Bp3 which is offset in another direction of the width direction from the center position Bc do not overlap with each other. However, in the exemplary embodiment, as described above, in consideration of that the length L550 of the needleless binding portion 550 is longer than the length L410 of the needle binding portion 410, the needleless binding portion 550 is formed at a position not to be pressed by the exit roll 333, and the height H550 of the needleless binding portion of the needleless binding portion 550 is lower than the height H410 of the needle binding portion of the needle binding portion 410, the amount of offsetting M550 is set to be smaller than the length L550 of the needleless binding portion 550. In other words, offsetting is performed so that the needleless binding portion 550 of the first needleless binding paper bundle Bp1 and the needleless binding portion 550 of the second needleless binding paper bundle Bp2 overlap with each other. In addition, offsetting is performed so that the needleless binding portion 550 of the first needleless binding paper bundle Bpi and the needleless binding portion 550 of the third needleless binding paper bundle Bp3 overlap with each other. Accordingly, the length L550 of the needleless binding portion 550 is longer than the length L410 of the needle binding portion 410, and freedom to form the needleless binding portion 550 at a position not to be pressed by the exit roll 333 may be increased.

For example, it is possible to exemplify that the amount of offsetting M550 is smaller than the amount of offsetting M410. That is, at the time of stacking on the stacking portion 34, an amount of the paper bundle B bound by the needleless binding device 500 being moved is set to smaller than an amount of the paper bundle B by bound the stapler 400 being moved. Accordingly, at the time of stacking on the stacking portion 34, since a speed at which the paper bundle B bound by the needleless binding device 500 is offset and exited may be set to be faster than a speed at which the paper bundle B bound by the stapler 400 is offset and exited, it is possible to speed up post-processing.

However, in a case in which offsetting is required in order to easily distinguish one paper bundle (one group of paper bundles) from the other paper bundles (the other group of paper bundles), an amount of offsetting which makes it possible to distinguish is set to a minimum amount of offsetting Mmin. That is, the amount of offsetting M550 is set to a value satisfying Expression (3) as follows.

$$Mmin\leq M550<M410 \quad (3)$$

Accordingly, even when the paper P of a part constituting the paper bundle B is difficult to be peeled off from the paper bundle B, it is possible to speed up a process in which the paper bundle B bound by the binding unit 320 is offset and exited, and to improve a convenience for easily distinguishing the paper bundles (group of paper bundles).

As described above, the binding processing device 300 is provided with the stapler 400 as an example of the needle binding unit, and the needleless binding device 500 as an example of the needleless binding unit which binds the paper bundle B without using the staple needle 401 by setting the length of the needleless binding portion 550 to be longer than the length of the needle binding portion 410 bound by the stapler 400. In addition, the binding processing device 300 is provided with the tamper 350 and the exit portion 330 as an example of an exiting unit, which exits the bound paper bundle B so that the amount of offsetting M410 of the paper bundles B (for example, first needle binding paper bundle Bs1 and second needle binding paper bundle Bs2) bound by the stapler 400 is smaller than the amount of offsetting M550 of the paper bundles B (for example, first needleless binding paper bundle Bp1 and second needleless binding paper bundle Bp2) bound by the needleless binding device 500. Also, according to the binding processing device 300, the paper P constituting the bound paper bundles B which are offset and exited is difficult to be peeled off from the paper bundle B.

Also, in a case in which the number of bundles of the paper bundle B which may be stacked on the stacking portion 34 is required to be increased by a user, the amount of offsetting M550 may be set to be zero. For example, as the number of bundles of the paper bundle B which may be stacked on the stacking portion 34 is increased, in a case in which offsetting is required by a user, the paper bundle B bound by the stapler 400 is offset, but the paper bundle B bound by the needleless binding device 500 may be exited by not being offset. Accordingly, when compared to a case in which the paper bundle B bound by the needleless binding device 500 is offset and exited, the paper P of a part constituting the paper bundle B may be difficult to be more accurately peeled off from the paper bundle B.

In addition, in a case in which the respective two needle binding portions 410 in one or another direction of the width direction (y direction) from the center position Bc of the paper bundle B (total four needle binding portions 410) are formed, the two needle binding portions 410 closer to the center are positioned to be the same as that of a case in which two needle binding portions 410 described with reference to FIG. 14 are formed. Also, the needle binding portion 410 being formed on the outside of the two needle binding portions 410 closer to the center is formed at a position distant away from the respective two needle binding portions 410 closer to the center more than the amount of offsetting M410. Also, further, in a case in which three or more needle binding portions 410 (total six or more needle binding portions 410) are respectively formed in one direction or another direction, the portions may be formed to be distant away from each other as a distance more than the amount of offsetting M410. In these cases, even in a case in which the plural needle binding portions 410 are formed in one or another direction of the width direction (y direction) from the center position Bc of the paper bundle B, the needle binding portion 410 does not become pressed by the exit roll 333, and a stacking height of the plurality of paper bundles B is suppressed.

Meanwhile, in a case in which the plural needleless binding portions 550 (total four or more needleless binding portions 550) are respectively formed in one or another direction of the width direction (y direction) from the center position Bc of the paper bundle B, a manner as follows may be applied. That is, the two needleless binding portions 550 closer to the center are positioned at the same position where two needleless binding portions 550 described with reference to FIG. 15 are formed, and another needleless binding portions 550 are formed on the outside of the two needleless binding portions 550 closer to the center. However, a gap between the two needleless binding portions 550 closer to the center and the needleless binding portions 550 positioned on the outside of the two needleless binding portions 550 may be greater than or smaller than the amount of offsetting M550. Accordingly, the length L550 of the needleless binding portion 550 is longer than the length L410 of the needle binding portion 410, and freedom to form the needleless binding portion 550 at a position not to be pressed by the exit roll 333 may be increased.

<Second Exemplary Embodiment>

Figure 16:
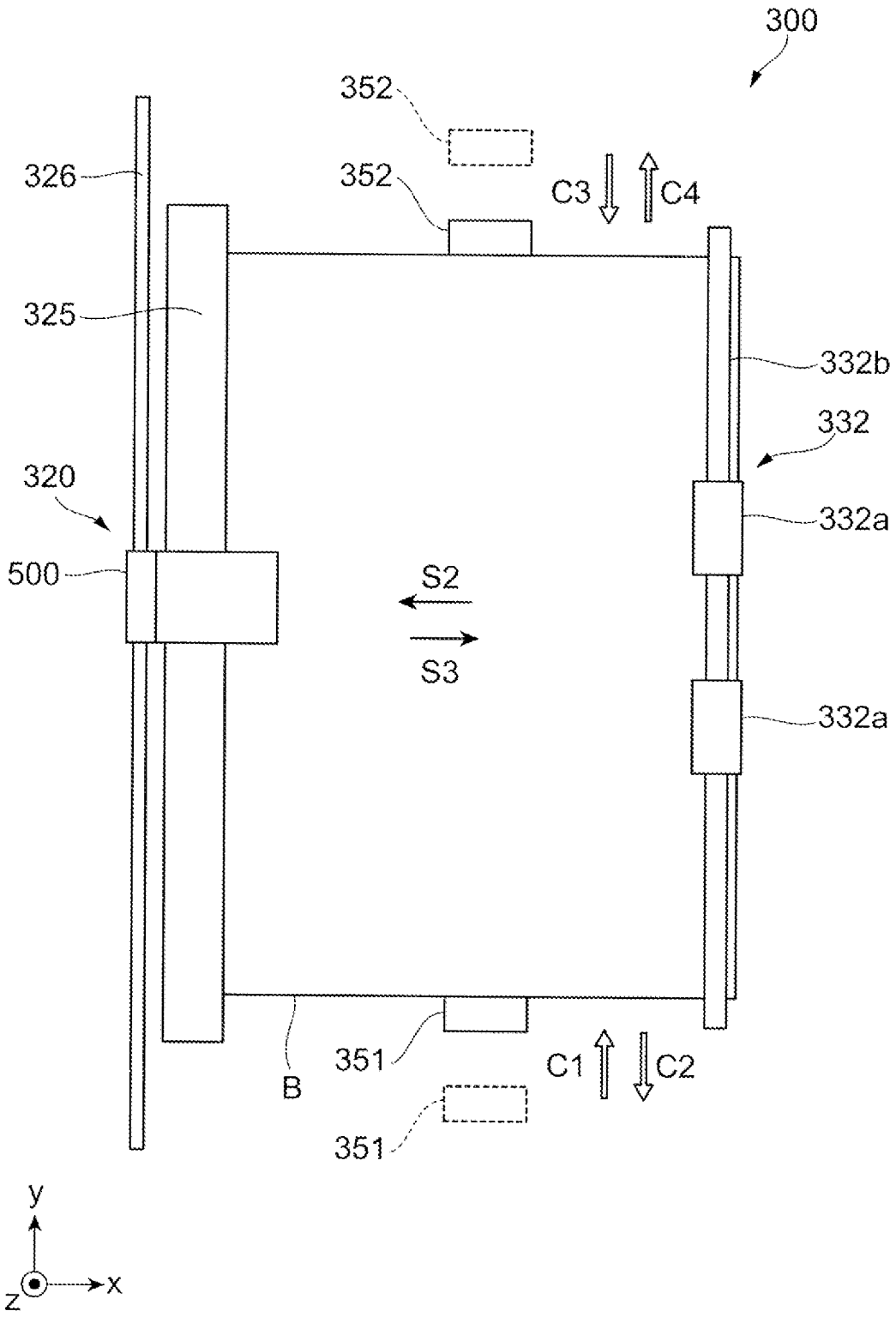
FIG. 16 is a view illustrating a schematic configuration of a binding processing device according to a second exemplary embodiment.

FIG. 16 is a view illustrating a schematic configuration of a binding processing device 300 according to a second exemplary embodiment.

Hereinafter, a different point of the binding processing device 300 according to the second exemplary embodiment from the binding processing device 300 according to the first exemplary embodiment will be described.

The binding processing device 300 according to the second exemplary embodiment is different from the binding processing device 300 according to the first exemplary embodiment in that a binding unit 320 is provided with the stapler 400. That is, the binding unit 320 of the binding processing device 300 according to the second exemplary embodiment is provided with the needleless binding device 500 as an example of the needleless binding unit which binds the paper bundle B without using needles.

Also, in the binding processing device 300 according to the second exemplary embodiment, when the second needleless binding paper bundle Bp2 (refer to FIG. 8) bound by the needleless binding device 500 is offset with respect to the first needleless binding paper bundle Bp1 (refer to FIG. 8) bound by the needleless binding device 500, offsetting is performed so that the needleless binding portion 550 of the first needleless binding paper bundle Bpi and the needleless binding portion 550 of the second needleless binding paper bundle Bp2 overlap with each other. That is, the amount of offsetting M550 of the first needleless binding paper bundle Bp1 and the second needleless binding paper bundle Bp2 (refer to refer to FIG. 8) is set to be smaller than the length L550 of the needleless binding portion 550.

That is, the binding processing device 300 according to the second exemplary embodiment is provided with the needleless binding device 500 as an example of the needleless binding unit which binds the paper bundle B without using needles, and the tamper 350 and the exit portion 330 as an example of an exiting unit which offsets and exits the paper bundles, such that the needleless binding portion 550 of the first needleless binding paper bundle Bpi as an example of a first paper bundle bound by the needleless binding device 500 and the needleless binding portion 550 of the second needleless binding paper bundle Bp2 as an example of a second paper bundle bound by the needleless binding device 500 overlap with each other.

According to the binding processing device 300 according to the second exemplary embodiment configured as described above, even when the length of the width direction (y direction) of the needleless binding portion 550 is set to be longer than, for example, the needle binding portion 410 of the stapler 400 of the binding processing device 300 according to the first exemplary embodiment in order to increase a binding force of the needleless binding portion 550, the needleless binding portion 550 may be formed at a position not to be pressed by the exit roll 333. As a result, the paper P constituting the bound paper bundle B which is offset and exited is difficult to be peeled off from the paper bundle B.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A binding processing device comprising:

a needle binding device forming a needle binding portion configured to bind a paper bundle using a needle;

a needleless binding device forming a needleless binding portion configured to bind the paper bundle without using a needle; and a plurality of exit rolls configured to output the bound paper bundle, the needle binding portion and the needleless binding portion being formed on the paper bundle at positions that are not to be pressed by the plurality of exit rolls, a distance between the needleless binding portion and a center of the plurality of exit rolls being equal to or greater than a distance between the needle binding portion and the center of the plurality of exit rolls.

2. The binding processing device according to claim 1, wherein a distance between the needleless binding portion and an end portion of an exit roll of the plurality of exit rolls is equal to or greater than a distance between the needle binding portion and the end portion of the exit roll of the plurality of exit rolls.

3. The binding processing device according to claim 1, wherein:

the needle binding device and the needleless binding device are configured to move in orthogonal directions that are orthogonal with respect to an exit direction of the paper bundle by the exit roll to form a plurality of needle binding portions and a plurality of needleless binding portions on the paper bundle along one of the orthogonal directions from a center of the paper bundle in the orthogonal directions, and an average of distances from an end portion of the plurality of exit rolls to the plurality of the needleless binding portions is equal to or greater than an average distance from the end portion of the plurality of exit rolls to the plurality of the needle binding portions.

4. The binding processing device according to claim 3, wherein a sum of lengths of the plurality of the needleless binding portions is greater than a sum of lengths of the plurality of the needle binding portions.

5. The binding processing device according to claim 1, wherein a distance between the needleless binding portion and a center of the paper bundle in an orthogonal direction that is orthogonal with respect to the exit direction of the paper bundle by the exit roll is equal to or greater than a distance between the needle binding portion and the center of the paper bundle.

6. The binding processing device according to claim 1, wherein:

the needle binding device and the needleless binding device are respectively configured to move in at least two orthogonal directions that are orthogonal with respect to an exit direction of the bound paper bundle by the exit roll to form a plurality of needle binding portions and a plurality of needleless binding portions on the paper bundle along one orthogonal direction of the at least two orthogonal directions from a center of the paper bundle in the at least two orthogonal directions, and an average of distances from the center of the paper bundle to the plurality of the needleless binding portions is equal to or greater than an average of distances from the center of the paper bundle to the plurality of the needle binding portions.

7. The binding processing device according to claim 1, wherein the needleless binding portion has a length greater than a length of the needle binding portion.

8. The binding processing device according to claim 1, wherein:

the needle binding device and the needleless binding device are respectively configured to move in at least two orthogonal directions that are orthogonal with respect to an exit direction of the paper bundle by the exit roll to form a plurality of needle binding portions and a plurality of needleless binding portions on the paper bundle along one orthogonal direction of the at least two orthogonal directions from a center of the paper bundle in the at least two orthogonal directions, and a distance between two of the plurality of needleless binding portions closer to the center of the paper bundle is equal to or greater than a distance between two of the plurality of the needle binding portions closer to the center of the paper bundle.

9. A binding processing device comprising:

a needle binding device forming a needle binding portion configured to bind a paper bundle using a needle, the needle binding device forming two needle binding portions on two parts of the paper bundle, a needleless binding device forming a needleless binding portion configured to bind the paper bundle without using a needle, the needleless binding device forming two needleless binding portions on two parts of the paper bundle, a distance between two parts of the needleless binding portions is equal to or greater than a distance between two parts of the needle binding portions; and a plurality of exit rolls configured to output the bound paper bundle, the needle binding portion and the needleless binding portion being formed on the paper bundle at positions that are not to be pressed by the plurality of exit rolls.

10. A binding processing device comprising:

a needle binding device forming a needle binding portion configured to bind a plurality of paper bundles using a needle;

a needleless binding device forming a needleless binding portion configured to bind the plurality of paper bundles without using a needle, the needleless binding portion having a length greater than a length of the needle binding portion; and an exiting device configured to output bound paper bundles of the plurality of paper bundles such that an amount of offsetting between the bound paper bundles bound by the needleless binding device is less than an amount of offsetting between the bound paper bundles bound by the needle binding device, the needleless binding portions being formed on the paper bundle at positions that are not to be pressed by a plurality of exit rolls of the exiting device, a distance between the needleless binding portion and a center of the plurality of exit rolls being equal to or greater than a distance between the needle binding portion and the center of the plurality of exit rolls.

11. The binding processing device according to claim 10, wherein the exiting device offsets and outputs the plurality of paper bundles such that needleless binding portions of the bound paper bundles bound by the needleless binding device overlap with each other.

12. The binding processing device according to claim 10, wherein the exiting device offsets and outputs the plurality of paper bundles such that needle binding portions of the bound paper bundles bound by the needle binding device do not overlap with each other.

13. A paper processing system comprising:

an image forming apparatus configured to form an image on a paper; and the binding processing device according to claim 10, the binding processing device being configured to perform a binding process on one paper bundle of the plurality of paper bundles including a plurality of papers on which the image is formed by the image forming apparatus.

14. A binding processing device comprising:

a needleless binding device configured to form needleless binding portions each binding each paper bundle of a plurality of paper bundles without using a needle, and an exiting device that offsets and outputs the plurality of paper bundles such that a needleless binding portion of a first paper bundle of the plurality of paper bundles bound by the needleless binding device overlaps with a needleless binding portion of a second paper bundle of the plurality of paper bundles bound by the needleless binding device, the needleless binding portions being formed on each paper bundle at positions that are not to be pressed by a plurality of exit rolls of the exiting device, a distance between each of the needleless binding portions and a center of the plurality of exit rolls being equal to or greater than a distance between a needle binding portion and the center of the plurality of exit rolls.

15. The binding processing device according to claim 14, further comprising a needle binding device that forms a plurality of needle binding portions including the needle binding portion, each needle binding portion of the plurality of needle binding portions binding each paper bundle of the plurality of paper bundles using a needle, wherein:

the needleless binding device forms the needleless binding portions having a length greater than a length of each of the plurality of needle binding portions; and the exiting device offsets and outputs each paper bundle of the plurality of paper bundles such that a needle binding portion of a third paper bundle of the plurality of paper bundles bound by the needle binding device does not overlap with a needle binding portion of a fourth paper bundle of the plurality of paper bundles bound by the needle binding device.

16. The binding processing device according to claim 15, wherein the exiting device outputs each paper bundle of the plurality of paper bundles such that an amount of offsetting between the first paper bundle of the plurality of paper bundles and the second paper bundle of the plurality of paper bundles is smaller than an amount of offsetting between the third paper bundle of the plurality of paper bundles and the fourth paper bundle of the plurality of paper bundles.

17. A paper processing system comprising:

an image forming apparatus configured to form an image on paper; and the binding processing device according to claim 14, the binding processing device being configured to perform a binding process on a paper bundle of the plurality of paper bundles, the paper bundle including a plurality of papers on which the image is formed by the image forming apparatus.

* * * * *